United States Patent [19]

Fujimoto

[11] 4,057,243

[45] Nov. 8, 1977

[54] SHEET FEED TERMINATION DETECTOR

[75] Inventor: Sakae Fujimoto, Chofu, Japan

[73] Assignee: Ricoh Co., Ltd., Tokyo, Japan

[21] Appl. No.: 564,332

[22] Filed: Apr. 2, 1975

Related U.S. Application Data

[62] Division of Ser. No. 375,887, July 2, 1973, abandoned.

[30] Foreign Application Priority Data

| | | |
|---|---|---|
| July 11, 1972 | Japan | 47-68666 |
| July 24, 1972 | Japan | 47-73923 |
| July 24, 1972 | Japan | 47-73926 |
| July 27, 1972 | Japan | 47-75449 |

[51] Int. Cl.[2] ..... B65H 7/04

[52] U.S. Cl. ..... 271/256; 271/90; 271/117; 271/145

[58] Field of Search ..... 271/256, 258, 262, 263, 271/257, 260, 145, 103, 90, 109, 117

[56] References Cited

U.S. PATENT DOCUMENTS

| | | | |
|---|---|---|---|
| 3,098,650 | 7/1963 | Keil | 271/256 |
| 3,485,393 | 12/1969 | Wilder | 271/103 X |
| 3,713,646 | 1/1973 | Derc | 271/263 |

FOREIGN PATENT DOCUMENTS

| | | | |
|---|---|---|---|
| 753,188 | 7/1956 | United Kingdom | 271/263 |

*Primary Examiner*—Bruce H. Stoner, Jr.
*Attorney, Agent, or Firm*—Cooper, Dunham, Clark, Griffin & Moran

[57] ABSTRACT

A sheet feed apparatus feeds sheets, placed on a sheet receptacle, one by one toward a sheet processor. When the sheets on the receptacle are exhausted, the operation of the apparatus is interrupted by a signal from a signal emitter which operates to detect the termination of sheet delivery. The signal emitter is actuated upon the detection of the occurrence of a plurality of idling operations of the sheet feed apparatus.

7 Claims, 46 Drawing Figures

FIG. 32
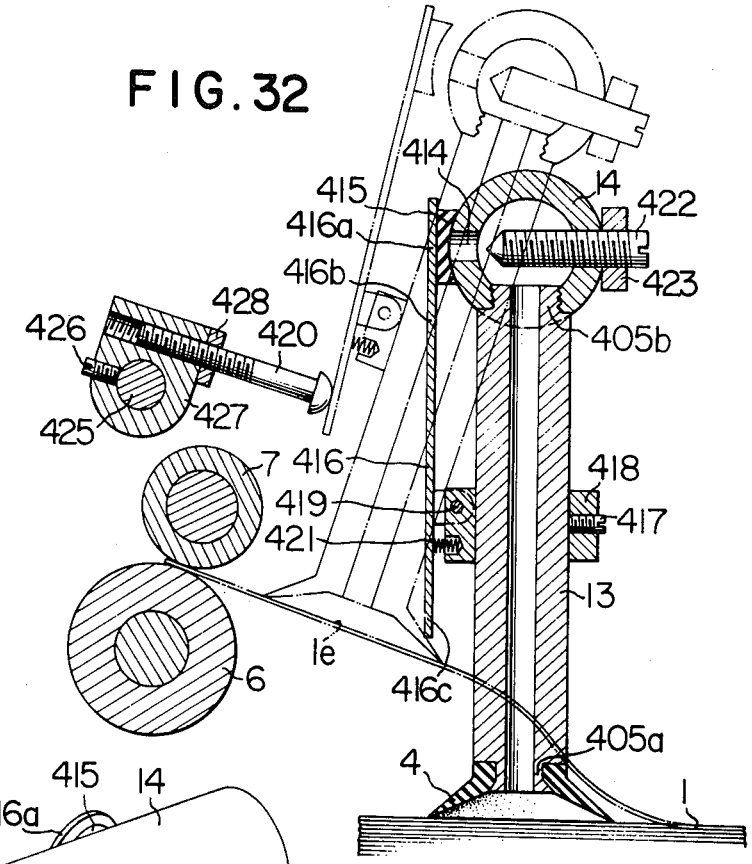
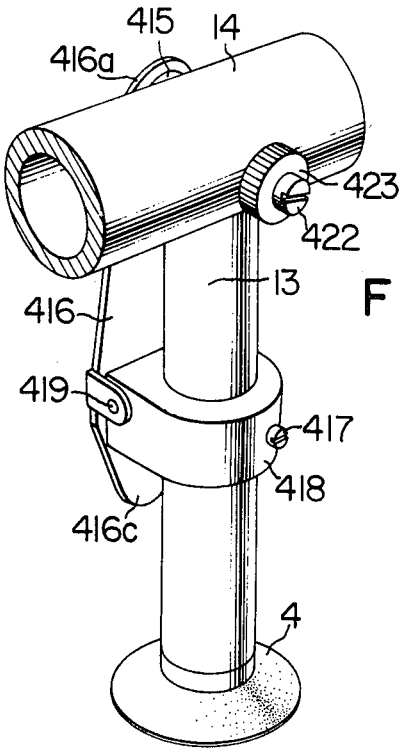
FIG. 33

SHEET FEED TERMINATION DETECTOR

This is a division, of application Ser. No. 375,887 filed July 2, 1973, now abandoned.

BACKGROUND OF THE INVENTION

The invention relates to a detector for detecting the termination of sheet delivery for use in an apparatus having a sheet receptacle, such as a printing machine or magnetic record transfer apparatus, to detect the termination of sheet delivery as when sheets, such as printing papers or slave sheets, have been exhausted on the sheet receptacle.

Such detection of the absence of sheets may take place by using a photoelectric transducer element, for example, which is disposed in the path of the sheets so as to produce a sheet feed pulse normally in response to the delivery of a sheet, so that the occurrence of a variation in such pulse may be considered as representing the termination of sheet delivery. However, to achieve a high accuracy with a photoelectric transducer element, an electrical circuit and peripheral unit of high quality must be used, which is expensive. On the other hand, where such detection takes place at a location other than a sheet receptacle, it takes an appreciable period of time from the termination of sheet delivery to the detection. This results in an inconvenience, that the entire apparatus or part thereof may continue to idle, when it is desired to interrupt the operation of the entire apparatus with the signal detecting the termination of sheet delivery.

Another problem involved with a sheet processing apparatus is the fact that the immediate interruption of the operation of the entire apparatus when the supply of sheets on the sheet receptacle is exhausted leads to an inconvenience that the last sheet is left within the apparatus without being processed. To prevent such an inconvenience, the operation of the apparatus must be continued subsequent to the detection of the termination of sheet delivery until the last sheet is processed and displaced out of the apparatus.

SUMMARY OF THE INVENTION

It is a first object of the invention to provide a detector for detecting the termination of sheet delivery in which the detection of the termination of sheet delivery is achieved mechanically by the cooperation between a detecting member mounted on the sheet receptacle and a sheet feed apparatus in a manner to reduce the cost without degrading the operational accuracy and in which such detection is effected in situ at the sheet receptacle to thereby prevent inconveniences caused by a delayed detection.

In accordance with the invention, the detector is mechanically constructed and can be provided inexpensively. The detector utilizes a sheet feed apparatus which is installed in any kind of sheet processing apparatus, thereby assuring a reliable operation. The detection of the termination of sheet delivery in situ at the sheet receptacle prevents a time lag in the detection.

It is a second object of the invention to provide a detector of sequential operation type having an accurate and inexpensive mechanical arrangement in which a sheet feed apparatus cooperates with a sheet detecting member to sequentially control the movement of the detecting member caused by the idling operation of the sheet feed apparatus subsequent to the termination of sheet delivery to thereby produce a signal in response to the final movement thereof without producing such signal in response to intermediate movement so as to obtain the continued operation of the apparatus mentioned above.

BRIEF DESCRIPTION OF THE DRAWINGS

FIG. 32 is a section of a sucker, illustrating its sucking action, FIG. 33 is a perspective view of the sucker and its associated members.

DETAILED DESCRIPTION OF PREFERRED EMBODIMENTS

Figure 1:
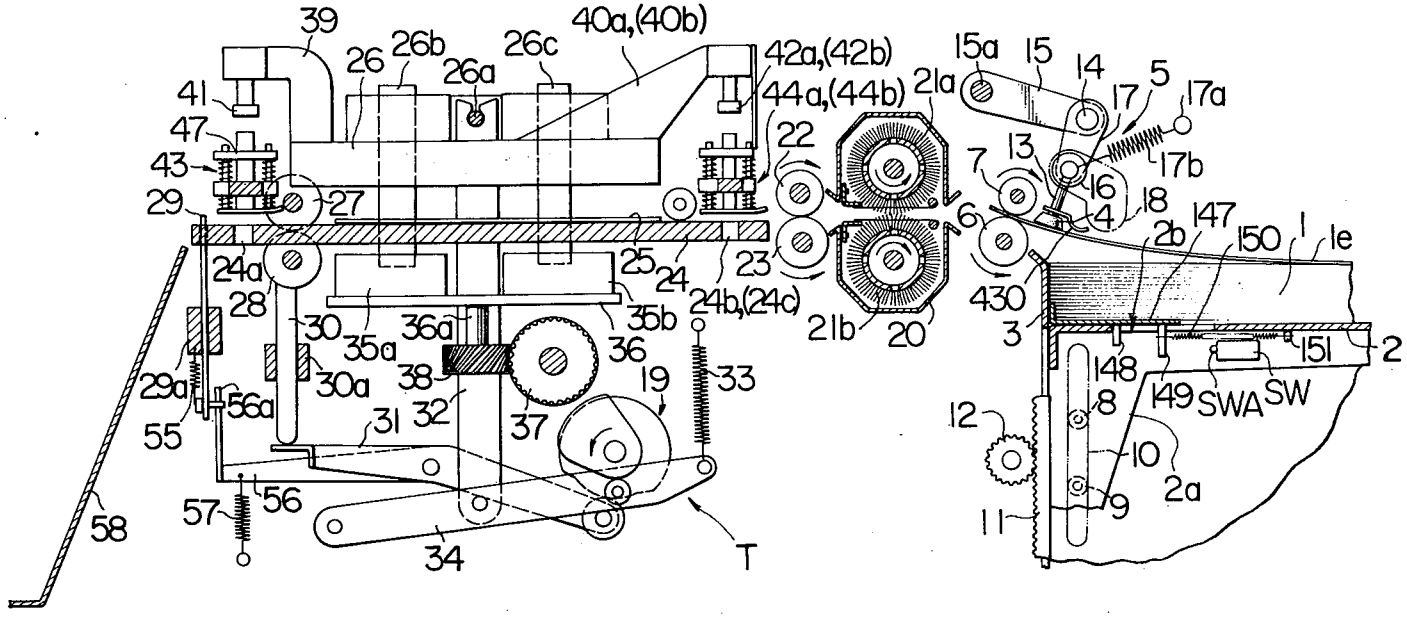
FIG. 1 is an elevational section showing a magnetic record transfer apparatus in which the invention is applied.

Referring to the drawings, the invention will be described as applied to an exemplary magnetic record transfer apparatus.

Shown on the right-hand side of FIG. 1 is a stack of slave sheets 1 having a magnetic recording layer placed on a sheet receptacle 2. The slave sheets 1 are disposed in alignment with each other by abutment against a front plate 3, and are adapted to be fed in turn, with the uppermost sheet first, by a sheet feed apparatus 5 toward the bite between a pair of rollers 6, 7 which contact each other under pressure while rotating continuously. The sheet feed apparatus has a plurality of suckers 4 (only one being shown) which are arranged in juxtaposition. The sheet receptacle 2 has a depending part 2*a* having vertically spaced rollers 8, 9 mounted thereon, these rollers being fitted in a vertical elongate slot 10 provided in a stationary member so as to support the receptacle 2 slidably in the vertical direction. A rack 11 is fixed to the left-hand side of the depending part 2*a* of the receptacle 2, and meshes with a pinion 12 which is rotated by detecting the height of the stack of sheets. The sheet receptacle 2 is raised every time a sheet 1 is fed so as to maintain the sheets in a position which enables the feeding of the sheet by the sucker 4.

The sucker 4 is mounted on the forward end of a tubular arm 13, together with a retainer member 430 which comprises a sheet metal and prevents a lap feed of sheets, the tubular arm 13 being secured to a hollow shaft 14. The hollow shaft 14 is pivotally mounted on an arm 15 which is mounted on and supported by a shaft 15*a*. The hollow shaft 14 has an arm 17 fixedly mounted thereon on which is pivotally mounted a roller 16 which in turn fits in a guide slot 18 formed in a stationary member. The arm 17 is urged counter-clockwise, as viewed in the drawing, by a spring 17*b* which has its one end anchored to a pin 17*a*.

The arm 15 is driven by the rotation of a group of control cams 19, shown in the lower part of FIG. 1, for rocking motion about the shaft 15*a*. The rocking motion of the arm 15 is effective to cause the arm 17 to reciprocate vertically within the slot 18, causing in turn a reciprocating motion of the tubular arm 13 and the sucker 14 in a path conforming to the configuration of the slot 18. The hollow shaft 14 is connected with a suction pump (not shown). Suction is applied to the hollow shaft 14 when the sucker 4 is lowered to press against the uppermost sheet 1 to cause it to suck such sheet 1, and subsequently the suction is disconnected when the sucker 4 is raised and moved to the left, as viewed in the drawing, to supply the sheet 1 toward the rollers 6, 7. The sheet feed apparatus 5 may alternatively comprise rollers and separator pawls well known in the art.

The sheet 1 engaged in the bite between the rollers 6, 7 is fed into a casing 20 to be cleaned when passing between a pair of brush rollers 21*a*, 21*b* disposed in opposing relationship therein. The rollers 21*a*, 21*b* are in the form of tubes each having a number of openings in its periphery and connected with a cleaning suction pump (not shown) for withdrawing powder dust removed from the slave sheet 1 by the brushes.

After passing through the casing 20, the cleaned slave sheet 1 is fed by a pair of in-feed rollers 22, 23 onto a table 24 within a sheet processor T, the rollers 22, 23 being held in engagement while rotating. A master plate 25 in the form of a sheet is placed on the central portion of the table 24, and a pressure plate 26 is disposed above the master plate. The slave sheet 1 is fed to a position on the master plate 25 and is positioned precisely by abutment of its forward edge with a positioning member 29 after passing through removal rollers 27, 28. At this time, the roller 28 is driven by a drive unit (not shown) for continuous rotation, but the roller 27 is placed in a slightly raised position by means of the group of cams 19 through a link 30, held by a support 30*a* mounted on a stationary member, and a lever 31, so that an excessive amount of feeding force is not imparted to the slave sheet.

The pressure plate 26 is connected through a shaft 26*a* with a link 32 which is in turn connected with a lever 34 that is urged by a spring 33 to follow the group of cams 19 for rocking motion, whereby the pressure plate 26 undergoes a vertical movement as the group of cams 19 rotate. When the slave sheet 1 is positioned in overlapping relationship with the master plate 25 and exactly positioned by the positioning member 29, the pressure plate 26 is lowered to press against the sheet to bring it into close contact with the master plate, the vertical movement of the pressure plate 26 being guided by stationary guide rods 26*b*, 26*c* which slidably fit in the lateral openings therein. A support plate 36 having a pair of electromagnets 35*a*, 35*b* mounted thereon is disposed below the table 24, and carries a shaft 36*a* on which is fixedly mounted a gear 38 which meshes with a drive gear 37 for normally rotating the supporting plate 36. The electromagnets 35*a*, 35*b* are energized only when the pressure plate 26 is in its lower position to produce a magnetic field while rotating, thereby achieving a transfer of record between the master plate and the slave sheet while they are in close contact with each other.

Figure 2:
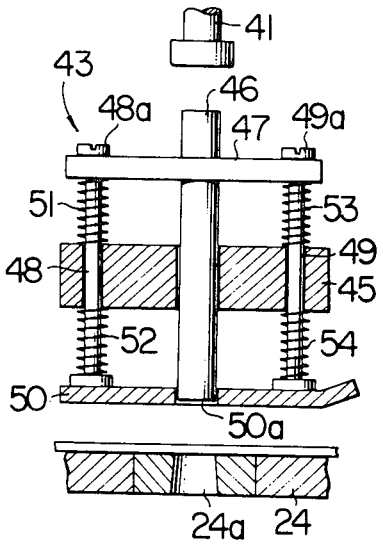
FIG. 2 is a section showing one example of a punch.

The pressure plate 26 is provided with an arm 39 and a pair of arms 40*a*, 40*b* (only one being shown) which extend to the left and to the right, respectively, the ends of which carry downwardly directed abutment fingers 41 and 42*a*, 42*b* (only one being shown). Punches 43 and 44*a*, 44*b* (only one being shown) are located at positions adjacent the sheet table 24 and directly below the abutment fingers 41 and 42*a*, 42*b*, respectively, and the table 24 is formed with openings 24*a* and 24*b*, 24*c* (only one being shown) which are aligned with the punches. Each of the punches 43, 44*a*, 44*b* is similarly constructed and an exemplary construction is shown in FIG. 2 for the punch 43. As shown, the punch 43 comprises a stationary support member 45 in which is loosely fitted a punch blade 46 having a plate 47 secured at its top. A pair of guide rods 48, 49 having locking heads 48*a*, 49*a* is loosely fitted in the apertures in the plate 47 and also in the apertures in the support member 45, and carry at their lower ends a bearing plate 50 having formed therein an aperture 50*a* through which the blade 46 is adapted to pass. Compressed coiled springs 51, 52, 53, 54 are disposed around both guide rods 48, 49 between the plate 47 and the support member 45, and between the support member 45 and the bearing plate 50.

Figure 3:
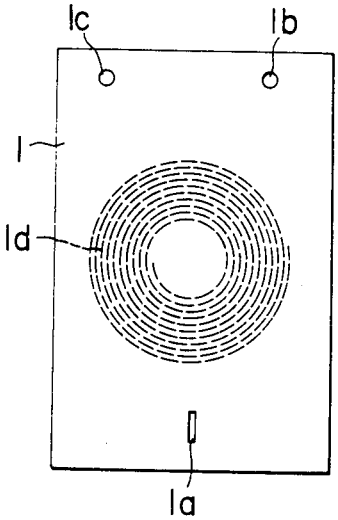
FIG. 3 is a plan view illustrating a copied magnetic sheet.

When the pressure plate 26 is lowered, the abutment fingers 41, 42 are lowered also to abut against the punch blade 46 of the respective punches. When the blades 46 of the respective punches are depressed by the abutment fingers 41, 42, they move downward through the supporting member 45 together with the guide rods 48, 49 against the resilience of the springs 51, 53, to hold the slave sheet 1 in position by means of the bearing plate 50, and to cooperate with the apertures 24*a* to form positioning holes 1*a*, 1*b*, 1*c* in the slave sheet 1, as shown in FIG. 3. In this manner, the slave sheet 1 is formed with positioning holes, and is also formed with a transferred magnetic recording track 1*d*, which is actually invisible, but is indicated by spiral dotted lines, thereby providing a copy sheet.

After the downward movement of the pressure plate 26, it begins to move upward by the rotation of the group of cams 19, whereupon the pressure acting between the removal rollers 27, 28 is increased whereby the sheet 1 which is now a copy sheet is fed to the left as viewed in FIG. 1.

The positioning member 29 is slidably carried by a support 29*a* which is mounted on a stationary member, is urged upward by a spring 55, and has its lower end in abutment with an engaging part 56*a* which is formed at one end of a lever 56. The other end of the lever 56 is held in abutment against the group of cams 19 by means of a spring 57. As a result, when the pressure plate 26 begins to move upward, the positioning member is depressed below the path of the sheet, thereby enabling removal of the slave sheet. Subsequently, the slave sheet which now represents a copy sheet is delivered to a sheet receiver 58, which is shown on the left-hand side of FIG. 1.

In the apparatus described above, sheets 1 placed on the sheet receptacle 2 are adapted to be carried therethrough for the transfer treatment of the magnetic record and then delivered to the receiver 58.

Figure 4:
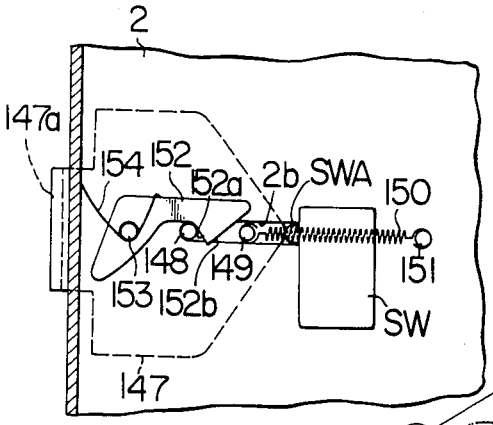
FIG. 4 is a bottom view of the detector for detecting the termination of sheet delivery according to one embodiment of the invention.
Figure 5:
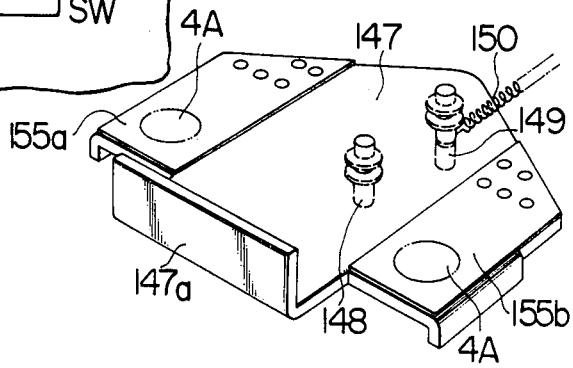
FIG. 5 is a perspective view illustrating a configuration of the detecting member used in the invention.

The sheet receptacle 2 is formed in its left-hand region, as viewed in FIG. 4, or in its front region, with an elongate slot 2*b* which extends in the direction in which the sheet is fed, and in which are loosely fitted a pin 148 and a switch operator 149 secured to the rear surface of a sheet-like detecting member 147 (see FIG. 5) placed on the sheet receptacle. The switch operator 149 is engaged with one end of a spring 150, the other end of which is anchored to a pin 151 which is fixedly mounted on the lower surface of the sheet receptacle 2 in its right-hand region. To the portion of the lower surface of the sheet receptacle 2 which is located to the left, as viewed in FIG. 4, of the elongate slot 2*b* is pivotally mounted a detent lever 152 at a pivot 153, the lever 152 carrying a detent finger 152*a*. The lever is urged clockwise by means of a spring 154 to lock the pin 148 in place with its detent finger 152*a*. An actuator SWA for a switch SW secured to the lower surface of the sheet receptacle is disposed in alignment with the right-hand end, as viewed in FIG. 4, of the elongate slot 2*b* and is associated with the switch operator 149. Normally, the pin 148 is blocked its movement by the lever 152, so that the switch operator 149 is removed from the actuator SWA.

The detector for detecting the termination of sheet delivery according to the invention as constructed above operates as follows:

Assuming that the sheet feeding operation of the sheet feed apparatus 5 has progressed to a point at which the last one of the slave sheets 1 has been fed, the sucker 4 attempts to suck and feed the detecting member 147 in the course of its sheet feeding operation. However, such feeding operation is only idling, and because of the gravity of the detecting member 147, it is only subjected to a slight upward movement as a result of the sucking operation.

As the detecting member 147 moves upward, the pin 148 is disengaged from the detent finger 152*a* of the lever 152, whereby the detecting member 147 is allowed to move to the right, as viewed in FIG. 4, under the resilience of the spring 150, thereby causing the switch operator 149 to push inwardly the actuator SWA for the switch SW.

As the actuator SWA is pushed inwardly, switch SW is operated, thereby producing a signal indicating the termination of sheet delivery. At its front end, the detecting member 147 is formed with an upwardly bent portion 147*a* which can be engaged by the sheets. When placing the sheets onto the sheet receptacle 2, the sheets are engaged with the bent portion 147*a* and pushed to the left, thereby permitting the detecting member 147 to be returned to its original position, whereby the pin 148 is displaced along the bevelled edge 152*b* of the lever 152 to move past it into fitting engagement with the detect finger 152*a* to complete the detent operation in a simple manner. On its upper surface, the detecting member 147 may be provided with thin sheets 155*a*, 155*b* of mirror finish in the region 4A at which the suckers 4 abut, thereby assuring a sucking operation of increased reliability by the suckers 4.

Several modified embodiments according to the invention will be described below. In these embodiments, parts equivalent in function to those described above are designated with corresponding reference characters, and will not be described in detail.

Figure 6:
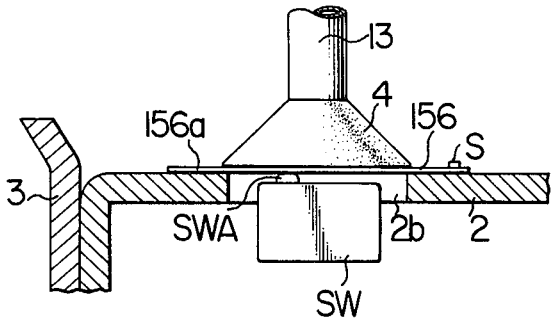
FIGS. 6 and 7 are elevational sections illustrating the manner of operation of the detector according to another embodiment of the invention.

In FIG. 6, the sheet receptacle 2 is shown formed with the slot 2*b*, above which is placed a detecting member 156 which comprises a resilient sheet such as a sheet metal and has its one end secured to the sheet receptacle 2, as by spot welding indicated at a dot S, so as to cover the slot.

Figure 7:
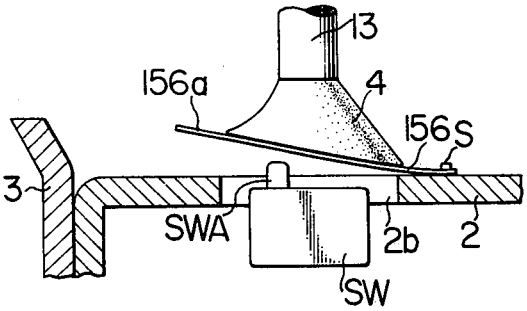

Before the suckers 4 attempt to suck the detecting member 156, the latter continues to bear against the actuator SWA for the switch SW by its own resilience, but upon termination of sheet delivery and when the suckers effect an idling sheet feeding operation, the free end 156*a* of the member 156 is raised, as shown in FIG. 7, as a result of such operation, thereby releasing the actuator SWA. Thereupon, the switch SW is operated to produce a signal indicating the termination of sheet delivery.

Figure 8:
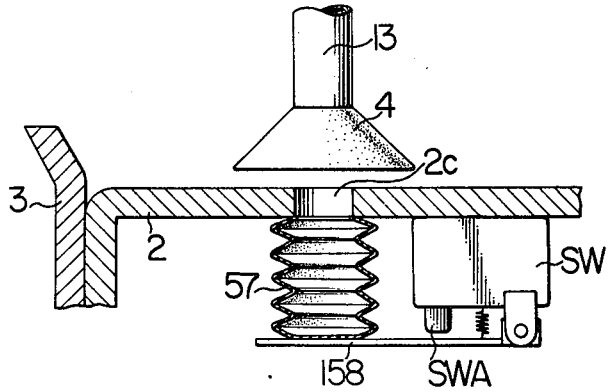
FIG. 8 is an elevational section of the detector according to a further embodiment of the invention.

In FIG. 8, the sheet receptacle 2 is formed with an aperture 2c which corresponds to the slot 2b mentioned previously and which is hermetically sealed by bellows 157 comprising rubber or the like which is mounted on the lower surface of the receptacle. The free end of the bellows bears against an auxiliary actuator 158 for the switch SW. Initially, the bellows 157 is in its relaxed position to depress the auxiliary actuator 158 downwardly, whereby the actuator SWA of the switch SW is maintained released. However, when the suckers 4 effect a sucking operation, the bellows 157 becomes constricted, whereby the auxiliary actuator 158 presses the actuator SWA of the switch SW inwardly, with consequent operation of the switch SW to produce a signal indicating the termination of sheet delivery.

Figure 9:
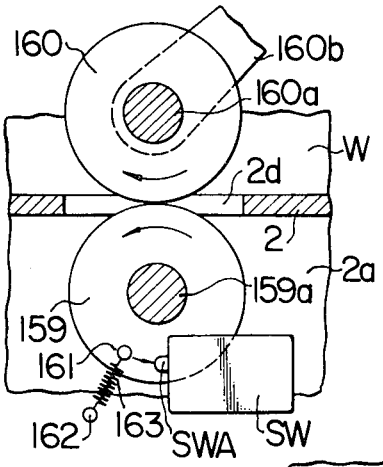
FIG. 9 is an elevational section showing an additional embodiment of the invention.

FIG. 9 shows an arrangement in which the front plate 3 is eliminated and the sheet feed apparatus comprises a pair of rollers. In this instance, the sheet receptacle 2 is formed with an aperture 2d, below which a sheet detecting roller 159 is disposed. The paper feeding is performed by a feed roller 160 which is carried across the side walls W by a support arm 160b so as to be movable in the vertical direction. The roller 159 has its shaft 159a rotatably supported by the depending wall 2a of the sheet receptacle, and a switch actuating pin 161 is fixedly mounted on the end face of the shaft. A spring 163 engages between the pin 161 and a stationary pin 162, and biases the roller 159 to a position in which the pin 161 is located adjacent to the actuator SWA of the switch SW.

Assuming that all the sheets have been delivered and subsequently the feed roller 160 is moved into contact with the roller 159 to effect an idling sheet feeding rotation, the roller 159 rotates by following the rotation of the roller 160, whereby the pin 161 moves to abut against the actuator SWA of the switch SW. In this example, the sheet receptacle may be adapted to rise or alternatively the feed roller 160 may be adapted to move downwardly.

Figure 10:
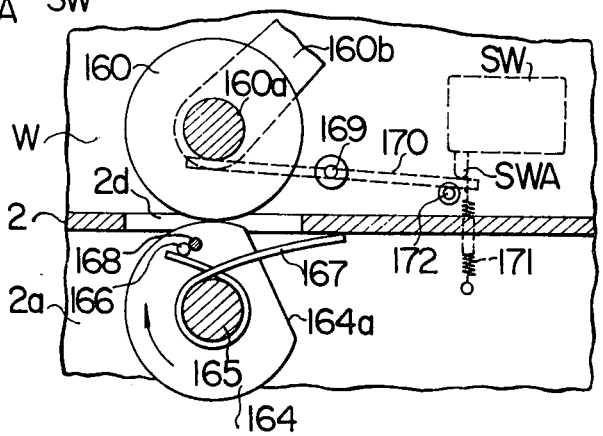
FIGS. 10 and 11 are elevational sections of still other embodiments of the invention.

FIG. 10 shows an example in which the sheet feeding roller 160 serves also as a detecting member. The roller 160 is adapted to abut against a slave sheet by its own gravity and to rotate by one revolution in the direction indicated by an arrow by the drive imparted to its shaft 160a in response to a sheet feed instruction. In this instance, as the supply of the sheets is diminished, the roller 160 is adapted to move toward the sheet receptacle.

The sheet receptacle 2 is formed with an aperture 2d in which is fitted a detecting roller 164 having a notch 164a in its periphery, the roller 164 being rotatably mounted by way of a shaft 165. A pin 166 is fixedly mounted on the end face of the roller 164 and is engaged by one end of a coiled spring 167 which is moved around the shaft 165. The other end of the spring 167 abuts against the lower surface of the sheet receptacle 2, whereby the roller 164 is urged to rotate clockwise, as viewed in this Figure, about the shaft 165 by virtue of the resilience of the spring 167. However, the rotation of the roller 164 is limited by abutment of the pin 166 against a pin 168 which is fixedly mounted on a stationary member, whereby the roller 164 is positioned so as to have its peripheral notch 164a removed from the aperture 2d and directed in the opposite direction from the direction in which the slave sheet is fed. A detecting lever 170 is pivotally mounted on the outer surface of the side wall W of the sheet receptacle 2 by means of a pivot 169, and has its one end adapted to coact with the shaft 160a of the roller 160 and its other end adapted to coact with the actuator SWA of the switch SW. At its one end, the lever 170 is pulled downwardly into abutment with a pin 172 by means of a spring 171 to thereby maintain the actuator SWA in its released position when the roller shaft 160a is not in its lower position.

When the sheets in the sheet receptacle have been exhausted, the sheet feeding roller 160 is brought into abutment with the detecting roller 164, as shown in FIG. 10. The roller 164 rotates in following relationship with the roller 160 as the latter rotates, whereby the notch 164 moves into a position opposite to the roller 160. When the roller 164 assumes such position, the roller 160 rapidly moves downwardly by an amount corresponding to the height of the notch, thereby moving the lever 170 to cause it to rotate counterclockwise about the shaft 172. Thereupon, the lever 170 presses against the actuator SWA of the switch SW to operate it to produce a signal indicating the termination of sheet delivery. When the sheets are replenished, the roller 160 is raised, whereby the roller 164 is returned to its initial position.

Figure 11:
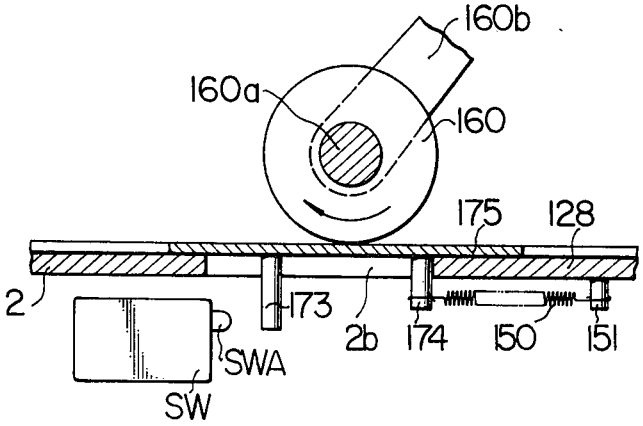

FIG. 11 shows an embodiment of a cooperating combination of a sheet feeding roller 160 and a detecting member 175 which functions in the similar manner as the detecting member 147. On its lower surface, the detecting member 175 is formed with a switch operator 173 and a pin 174, both of which fit in the elongate slot 2b. The pin 174 is engaged by one end of a spring 150 having its other end engaged with a pin 151 mounted on the lower surface of the sheet receptacle 2 at its right-hand portion, as viewed in this Figure, so as to locate the detecting member 175 in its starting position in which the pin 174 bears against the right-hand end of the elongate slot 2b. When the roller 160 moves into contact with the detecting member 175 upon termination of sheet delivery to move the detecting member 175 forwardly or to the left, as viewed in this Figure, as a result of the following idling sheet feeding operation, the switch operator 173 presses against the actuator SWA of the switch SW, thereby causing the switch SW to produce a signal indicating the termination of sheet delivery. When the roller 160 is raised upwardly as the sheets are loaded on the sheet receptacle, the sheet detecting member 175 is returned to its initial position under the resilience of the spring 150.

The interruption of the operation of the apparatus by detecting the fact that the sheets in the sheet receptacle have been exhausted results in a favorable interruption of the apparatus. With a magnetic record transfer apparatus, it is likely that the last sheet remains within the apparatus at an area approximately below the pressure plate 26. This can be prevented completely by maintaining the apparatus operative for a period of time sufficient to effect one more sheet feeding operation. Embodiments of apparatus which effect such completing operation by sequential detection of the termination of sheet delivery will be described with reference to FIGS. 12 to 30 wherein members common to all of these Figures are designated by like reference characters.

Figure 12:
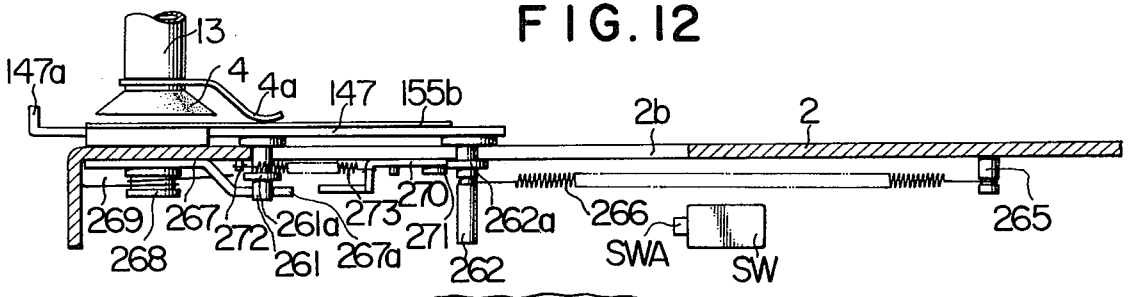
FIG. 12 is an elevational section of the detector of sequential operation type according to a still further embodiment of the invention.

In FIG. 12, the sheet receptacle 2 is formed with an elongate slot 2b in which are fitted a pin 261 and a switch operator 262 mounted on the lower surface of the detecting member 147 that is arranged on the sheet receptacle 2 for detecting the termination of sheet feed, the pin 261 and the switch operator 262 being prevented from disengagement by detent links 261a, 262a respectively. As mentioned previously, the detecting member 147 is provided with resilient sheets 155*a*, 155*b* (see FIG. 5) comprising sheet metal and having a smooth surface, on its opposite lateral sides in an area 4A against which the suckers 4 abut, the resilient sheets being secured thereto as by spot welding, indicated by *x* marks. The detecting member 147 may be constructed in a suitable configuration, the only requirement being that it is adapted to be sucked by the suckers 4.

Figure 13:
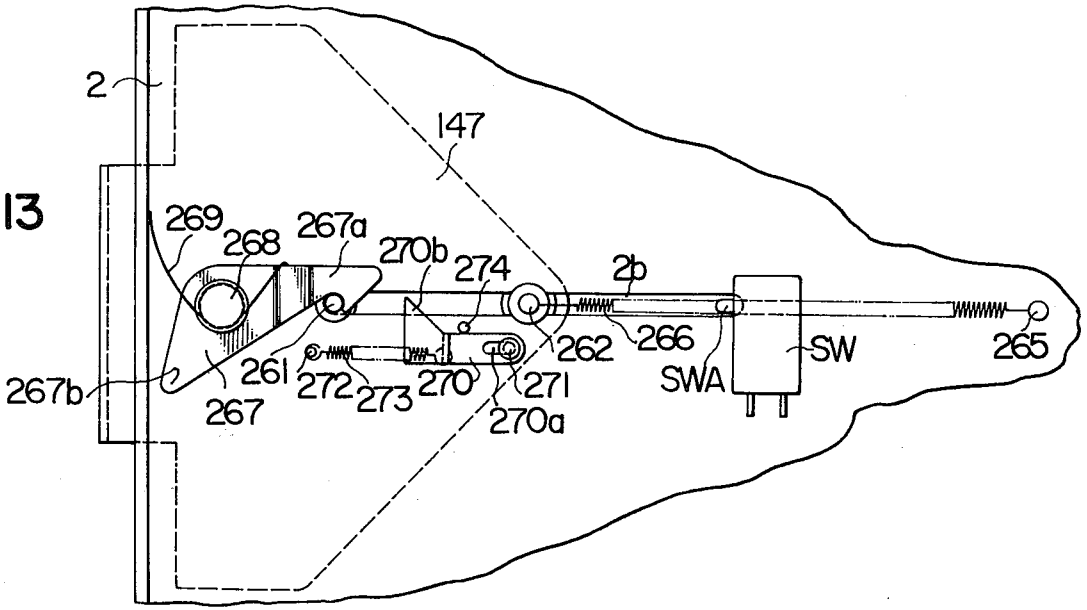
FIGS. 13 and 14 are bottom views illustrating the lay-out and the manner of operation of the apparatus shown in FIG. 12.

In the above arrangement of the detecting member 147, the switch operator 262 provided thereon is engaged by one end of a spring 266, the other end of which is engaged with a pin 265 that is fixedly mounted on the lower surface of the sheet receptacle 2 at its rear portion, thereby biasing the detecting member 147 rearwardly. Initially, the pin 261 is locked in position by engagement with a detent finger 267*a* of a detent lever 267, whereby the detecting member assumes an initial position as shown in FIGS. 12 and 13. The feeding of sheets is performed consecutively over the detecting member 147 while it remains in this position.

The detent lever 267 is rotatably mounted on the lower surface of the sheet receptacle 2 at its forward portion by way of a pivot 268, around which is wound a spring 269 which biases the detent lever to rotate clockwise, thereby holding the pin 261 in position. A detent member 270 which serves holding the pin 261 in successive positions is slidably mounted, laterally of the elongate slot 2*b*, on the lower surface of the sheet receptacle 2 by means of a pin 271 which fits in an elongate slot 270*a* formed in the base portion of the detent member. The detent member 270 is engaged with a spring 273 which is anchored to a pin 272 fixedly mounted on the lower surface of the sheet receptacle 2 so as to locate the detent member 270 in a position in which the rear end of the elongate slot 270*a* bears against a pin 271, with its detent finger 270*b* positioned within the elongate slot 2*b*. A guide pin 274 is fixedly mounted on the lower surface of the sheet receptacle 2 so as to engage the side of the detent member 270 which is located nearer the detent finger 270*b*. The actuator SWA of the switch SW which produces a signal indicating the termination of sheet delivery is disposed in the rear end of the elongate slot 2*b*.

Figure 14:
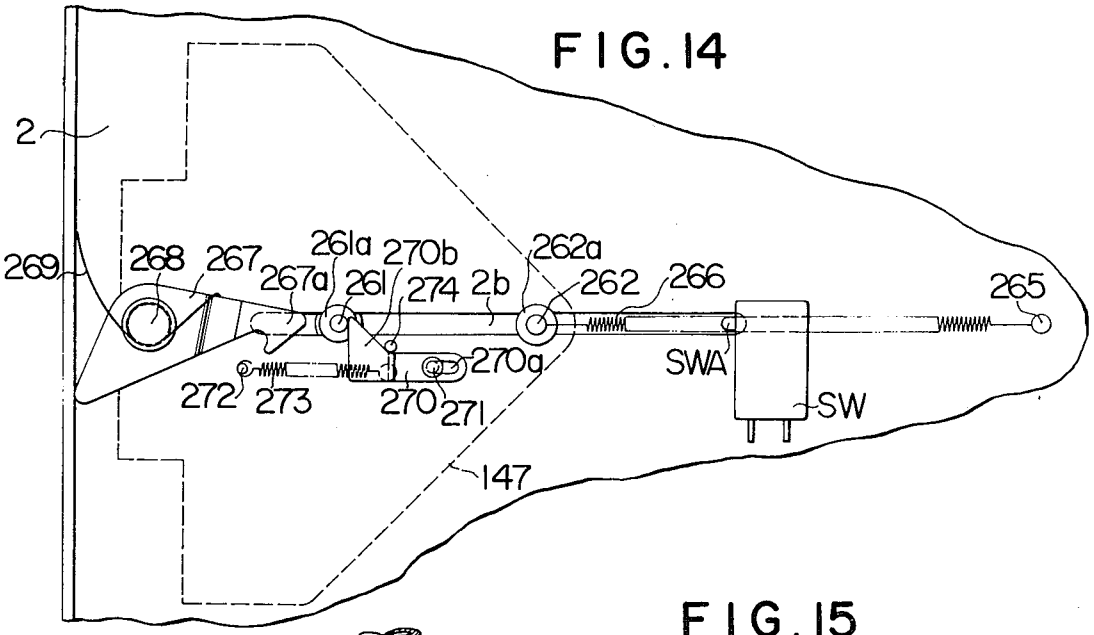

When the sheets in the sheet receptacle 2 have been successively sucked out by the suckers 4 and become exhausted, the suckers 4 then effect an idling operation to suck the detecting member 147, thereby raising it slightly. When the detecting member 147 is raised, the pin 261 is disengaged from the detent lever 267, whereby the detecting member 147 moves rearwardly within the elongate slot 2*b* under the resilience of the spring 266, and sinks down because of its own gravity, whereby it is caught by the waiting detent finger 270*b* of the detent member 270, as shown in FIG. 14, and is held in this position. At this time, the detent lever 267 remains in a position in which its arm end 267*b* bears against the depending portion of the receptacle 2 until the pin 261 is returned.

When the suckers effect an idling operation for the second time under this condition, the detecting member 247 is slightly raised again, whereby the pin 261 is disengaged from the detent member 270 and rapidly moves rearwardly under the resilience of the spring 266 to press against the actuator SWA with the switch operator 262, thereby causing a detection signal indicating the termination of sheet delivery to be produced. The displaced detecting member 147 is easily returned to its initial position when the sheets are replenished onto the sheet receptacle by engaging the sheets with the bent portion 147*a* and pushing it in the opposite direction.

It will be noted that with this apparatus, the signal indicating the termination of sheet delivery is produced by the movement of the detecting member 147 which occurs as a result of the second idling operation of the suckers 4, thereby allowing a timing adjustment to be achieved in a reasonable and inexpensive manner as compared with the adjustment achieved by the use of an expensive unit such as a timer, for example.

Figure 15:
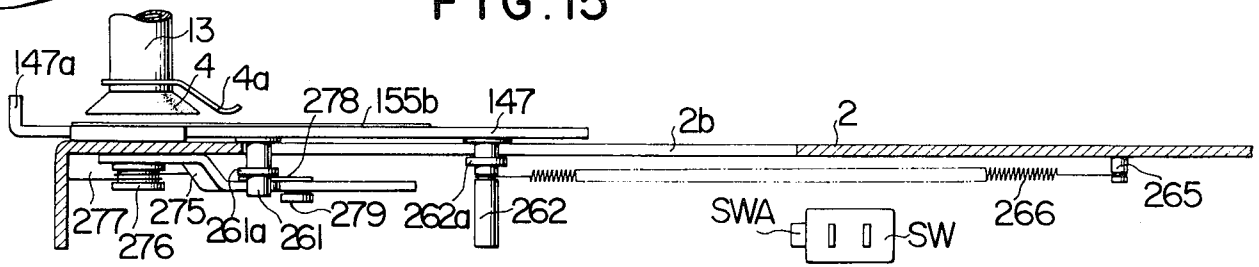
FIG. 15 is an elevational section of the detector of sequential operation type according to another embodiment of the invention.
Figure 16:
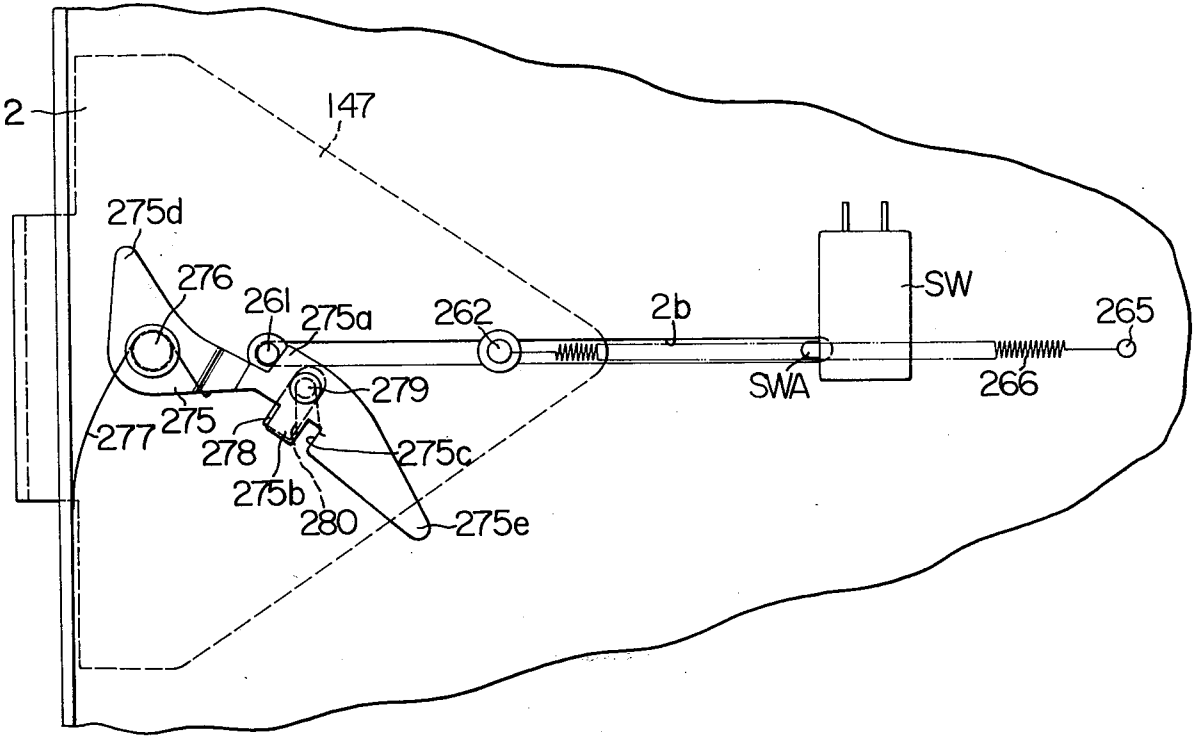
FIGS. 16 and 17 are bottom views illustrating the layout and the manner of operation of the apparatus shown in FIG. 15.
Figure 17:
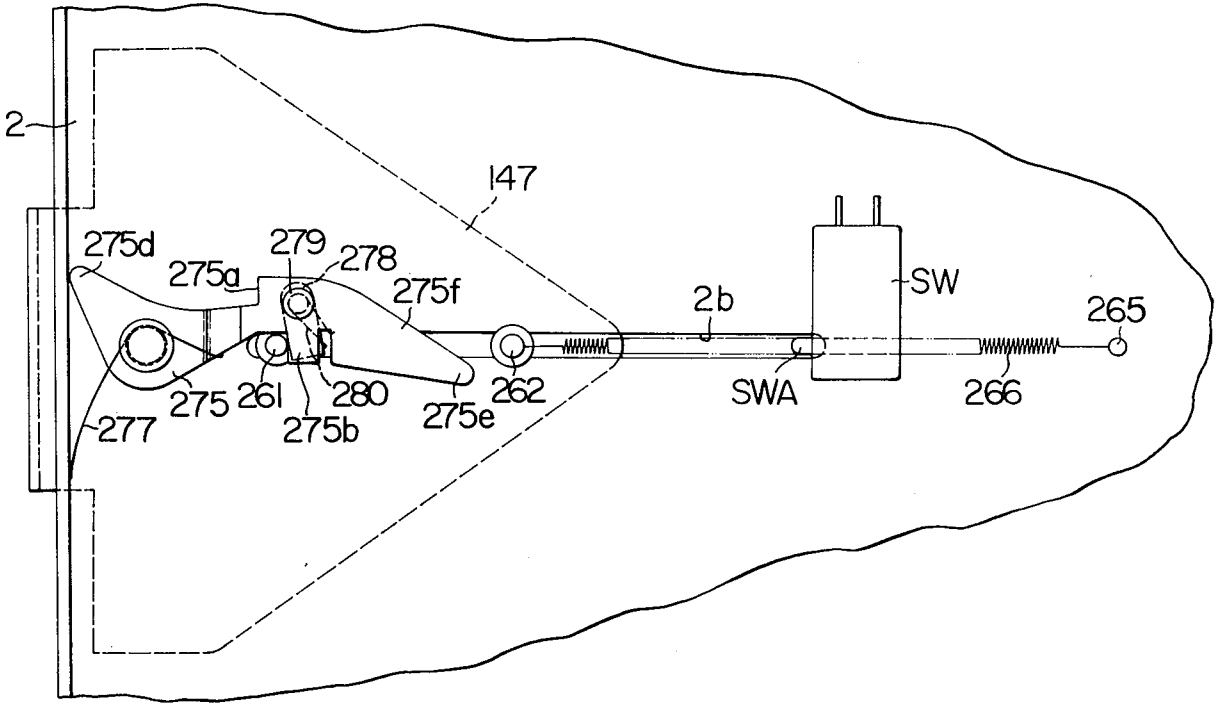
Figure 18:
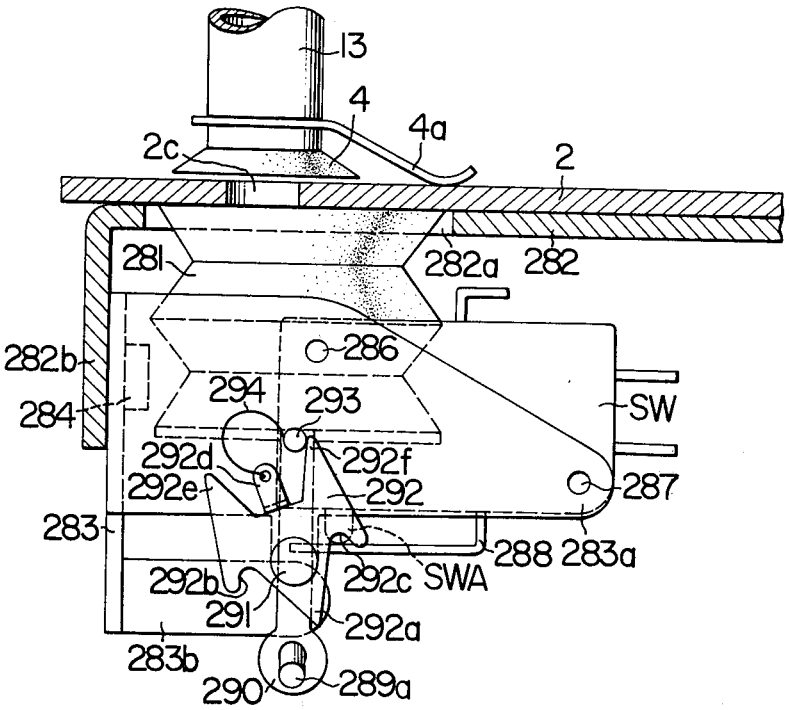
FIG. 18 is an elevational section of the detector of sequential operation type according to a further embodiment of the invention.

Another embodiment of the invention is shown in FIGS. 15 to 17. In FIGS. 15 and 16, the pin 261 on the detecting member 147 is locked by a first detent edge 275*a* of a sequentially detenting lever 275 which is pivotally mounted on the lower surface of the sheet receptacle 2 at its front portion by way of a shaft 276 and which is urged counterclockwise about the shaft 276, as viewed in FIG. 16, by a spring 277 wound about the shaft to lock the pin 261 with the first detent edge 275*a* and to have itself locked in position by the pin 261.

The detent lever 275 has a second detent finger 275*b* on the opposite side from the first detent edge 275*a* and carries a buffering member 278 that is journalled at stud 279 on the lower surface of the detent lever 275 so as to be positioned adjacent to the second detent finger. A spring 280 is wound around the stud 279 and has its one end engaged with the inner end of a notch 275*c* formed in the detent lever 275 and its other end engaged with the rear part of the buffering member 278 so as to locate the buffering member in a position in which it protrudes forwardly from the edge of the second detent finger 275*b* in the initial condition.

When the sheets have been completely delivered and the detecting member 147 is slightly raised by the subsequent idling operation of the suckers 4, the pin 261 is disengaged from the detent edge 275*a* of the detent lever 275, which therefore rotates counterclockwise under the action of the spring 277 to a position (shown in FIG. 17) in which its arm 275*d* abuts against the depending part of the sheet receptacle 2. On the other hand, the raised detecting member 147 falls down by its own gravity, whereby the pin 261 rides on the detent lever 275. The pin 261 bears against the front edge of the buffering member 278 to be damped before engaging with the second detent finger 275*b*. Such operation of the detecting member 147 and the detent lever 275 takes place very rapidly, almost instantaneously.

When the suckers effect an idling operation for the second time while the pin 261 is engaged with the second detent finger 275*b*, the detecting member 147 is raised again by a small vertical distance which is sufficient to make the pin 261 disengaged from the second detent finger 275*b*, and allows it to slide on the lever 275, whereby the detecting member 147 moves rearwardly under the action of the spring 266 to cause the switch operator 262 to push the actuator SWA of the switch SW inwardly. At this time, the detent lever 275 remains in the position shown in FIG. 17 with its arm 275*e* having a rear bevelled edge 275*f* positioned in alignment with the elongate slot 2*b*, thereby allowing the pin 261 to be readily engaged with the first detent edge 275*a* when the detecting member 147 is returned to its initial position.

In this manner, the movement of the detecting member which occurs in the first step can be made small by providing a sequential control of the single detent lever in accordance with the invention. Specifically, the embodiment shown in FIG. 15 provides a distance of movement of the pin 261 occurring in the first step which is less than that of the embodiment shown in FIG. 12, thereby improving the positional relationship with the suckers 4.

Figure 19:
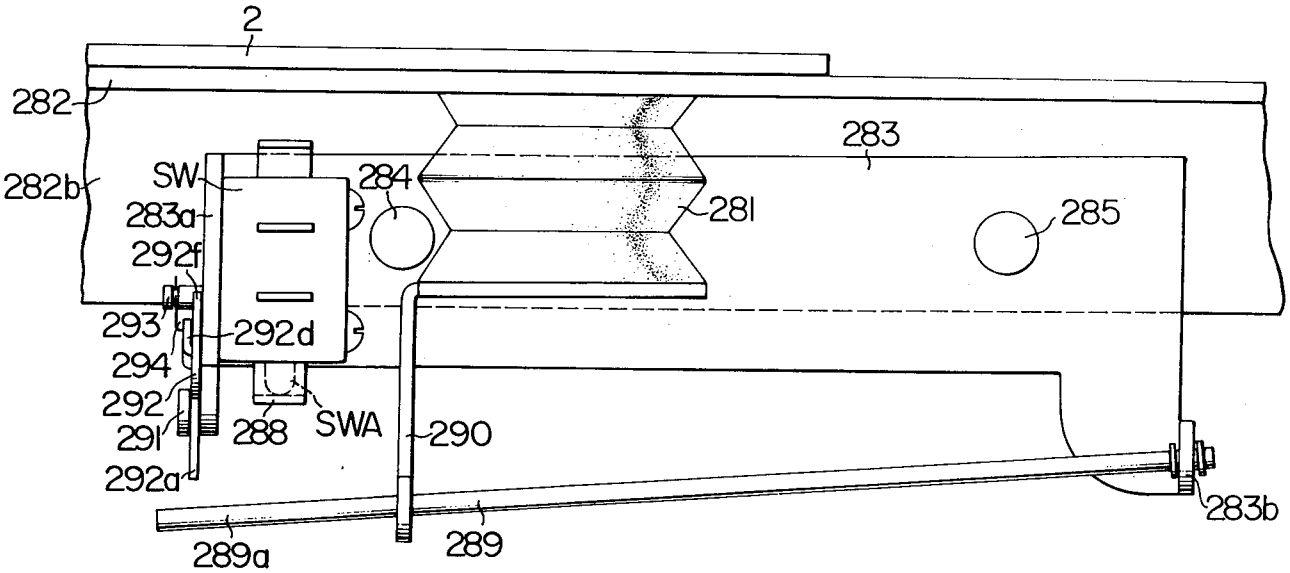
FIG. 19 is a left-hand elevation of the apparatus shown in FIG. 18.
Figure 20:
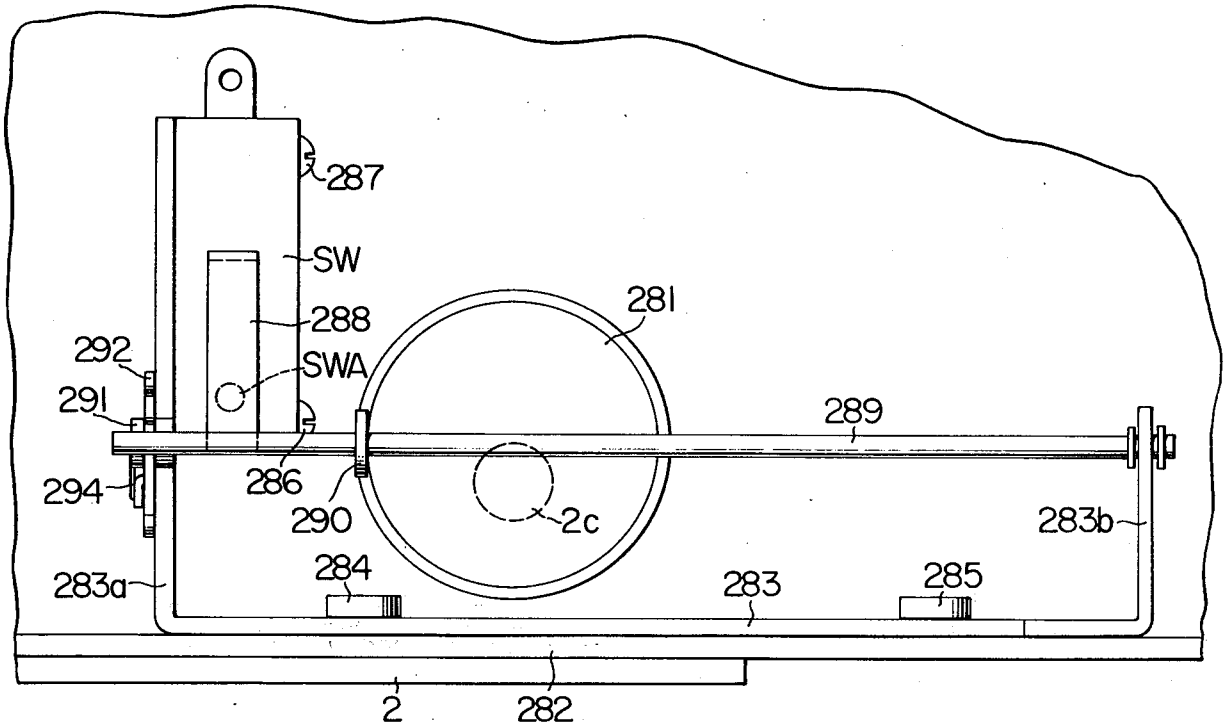
FIG. 20 is a bottom view illustrating a lay-out of the apparatus shown in FIG. 18.

FIGS. 18 to 21 illustrates the use of a bellows 281 as a detecting member, the bellows being mounted below a suction hole 2c formed in the forward part of the sheet receptacle 2. An auxiliary plate 282 having a bellows mounting aperture 282a is mounted on the lower surface of the sheet receptacle 2. The auxiliary plate 282 has a depending portion 282b at its front end, on which a support plate 283 is secured by means of set screws 284, 285. The opposite ends of the support plate 283 are bent to form supports 283a, 283b (see FIG. 20), a switch SW being secured on the inner wall of one of the supports 283a by means of set screws 286, 287 (see FIG. 18). The switch SW is associated with an auxiliary actuator 288, below which is disposed a switch operating rod 289. As shown in FIG. 19, the switch operating rod 289 is loosely fitted in the support 283b of the support plate 283 at its one end and has its front end fitted in a connecting member 290 which is provided on the bottom of the bellows 281.

The front end 289a of the switch operating rod 289 is arranged to coact with a control member 292 that is pivotally mounted at pivot 291 on the support 283a of the support plate 283. At its one end, the control member 292 is formed with a pointed deflecting edge 292a (see FIG. 18) which extends toward the switch operating rod 289, and a pair of recesses 292b, 292c located on the opposite sides thereof, and it is also formed at the end opposite from the pointed edge 292a with a central spring mount 292d and a pair of engaging fingers 292e, 292f. The spring mount 292d is engaged with one end of a spring 294, the other end of which is secured to a pin 293 that is fixedly mounted on the support 283a. The spring 294 serves moving the point of action, and in the initial condition shown in FIG. 18, the control member 292 is positioned with its engaging finger 292f bearing against the pin 293 and with its pointed edge 292a located to the right of the path of the forward end 289a of the switch operating rod 289. It is to be noted that the auxiliary actuator 288 of the switch SW extends to the region of the recess 292c in the control member 292, but does not extend to the region of recess 292b.

Figure 21:
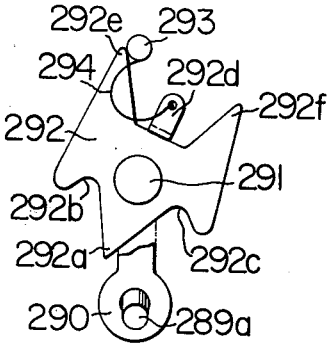
FIG. 21 is a side elevation illustrating the manner of operation of the control member shown in the apparatus of FIG. 18.

Assuming that the sheets have been entirely delivered by the suckers 4, the subsequent idling operation of the suckers applies a suction to the bellows 281 which therefore constricts to raise the front end 289a of the switch operating rod 289 through the connecting member 290. During such movement of the switch operating rod 289, its front end 289a is deflected toward the recess 292b by the pointed edge 292a of the control member 292, thus bearing against the recess 292b. When the recess 292b is pressed, the control member 292 rotates clockwise about the pivot 291, thereby moving the position of the mount 292d from the left-hand side to the right-hand side of the pin 293 to cause the engaging finger 292e to abut against the pin 293 as shown in FIG. 21 and also shift the pointed edge 292a to the left of the path of the front end 289a of the switch operating rod 289.

When the controling member 292 assumes such a position, the front end 289a of the switch operating rod 289 falls down to its original position as the suckers 4 move away from the sheet receptacle 2 and the bellows 281 expands. When the suckers 4 effect an idling sheet feeding operation for the second time, the front end 289a of the switch operating rod 289 is now deflected toward the recess 292c in the control member 292 to rotate the control member 292 counterclockwise about the pivot 291, thereby pressing against the auxiliary actuator 288 of the switch SW to operate it and causing it to produce a signal indicating the termination of sheet delivery. In this manner, a sequential detection of the movement of the bellows 281 is permitted by causing the control member 292 to deflect the path of the front end 289a of the switch operating rod 289.

Figure 22:
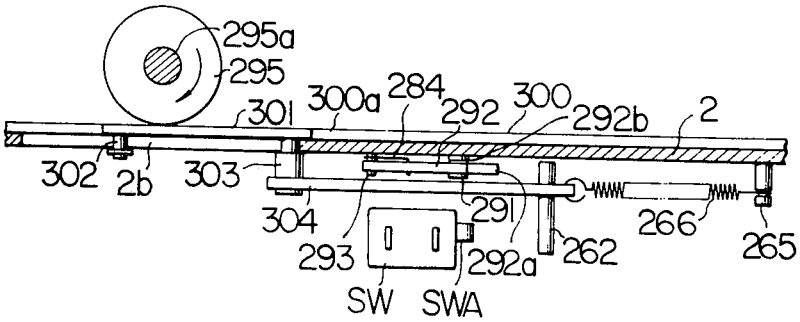
FIG. 22 is an elevational section of the detector of sequential operation type according to an additional embodiment of the invention.

FIG. 22 shows a sheet feeding roller 295 used in the sheet delivery operation. A plate 300 having a groove 300a therein is mounted on the sheet receptacle 2, and a planer detecting member 301 is loosely fitted in the groove 300a. The sheet feeding roller 295 has its shaft 295a suitably supported, and is positioned above the detecting member 301. The roller 295 is adapted to undergo one revolution during delivery of a sheet so as to deliver a sheet on the receptacle 2 one by one. It will be appreciated that a cooperating sheet separator pawl (not shown) may be used in combination therewith and that the roller 295 may be lowered or alternatively the sheet receptacle 2 may be raised as the supply of sheets is diminished in order to maintain the roller 295 in pressure contact with the sheet.

On its lower surface, the detecting member 301 is provided with a pair of pins 302, 303 which fit in the elongate slot 2b in the sheet receptacle, the pin 303 having rotatably mounted thereon a connecting member 304 carrying a switch operator 262 at its rear end. In the initial condition, the detecting member 301 is positioned with its pin 303 bearing against the rear edge of the elongate slot 2b under the action of a spring 266 engaged with the rear end of the connecting member 304. The switch SW is placed below the connecting member 304 and is associated with its actuator SWA which is located forwardly of the switch operator 262. The control member 292 mentioned above in connection with FIGS. 18 to 21 is pivotally mounted at pivot 291 on the lower surface of the sheet receptacle 2 above the switch SW, and has its orientation determined by the spring 294 and the pin 293 fixedly mounted on the receptacle 2.

As before, the control member 292 is adapted to deflect the path of the movement of the switch operator 262, and in the initial condition, it is positioned with its pointed edge 292a lying below the path of the switch operator 262, as viewed in FIG. 23. In this position, the recess 292b is located below the actuator SWA.

Figure 23:
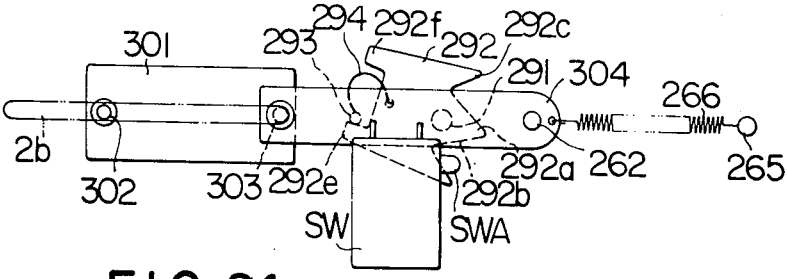
FIGS. 23 to 25 are bottom views illustrating the layout and the manner of operation of the apparatus shown in FIG. 22.
Figure 24:
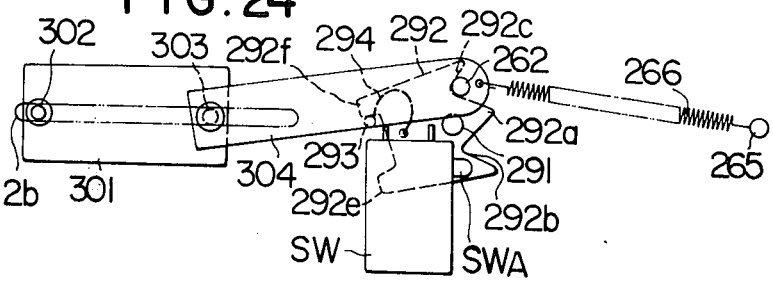
Figure 25:
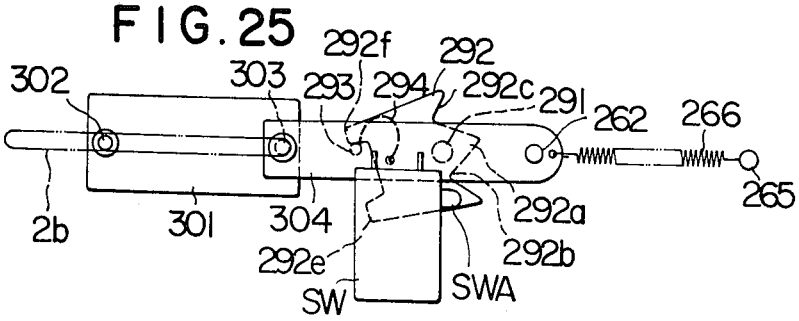

When the sheets on the sheet receptacle have been completely delivered by the sheet feeding roller 295 and the apparatus assumes the position shown in FIGS. 22 and 23, the subsequent sheet feeding operation of the roller 295 will be only idling, merely moving the detecting member 301 in the forward direction against the action of the spring 266. As the detecting member 301 is moved forwardly, the switch operator 262 presses against the recess 292c in the control member 292, as shown in FIG. 24, thereby rotating the control member 292 counterclockwise about the pivot 291, as viewed in this Figure. As a result, the control member 292 is positioned with its pointed edge 292a located above the path of the movement of the switch operator 262 in response to the first movement of the detecting member 301. When the roller 295 ceases its feeding rotation, the detecting member 301 is returned to its original position together with the connecting member 304 and pin 262 under the action of the spring 266. Subsequently, when the roller 295 effects an idling sheet feeding operation for the second time, the switch operator 262, in following the moving detecting member 301, now presses against the recess 292*b* and simultaneously presses against the actuator SWA, causing the switch SW to produce a signal indicating the termination of sheet delivery.

Figure 26:
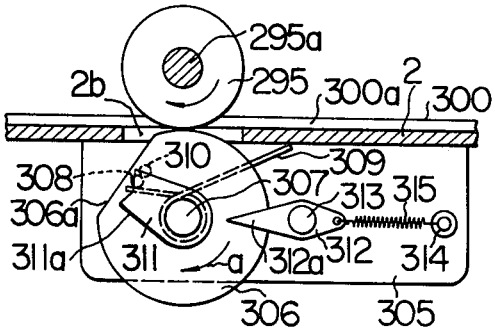
FIG. 26 is an elevational section of another embodiment of the detector of sequential operation type.
Figure 27:
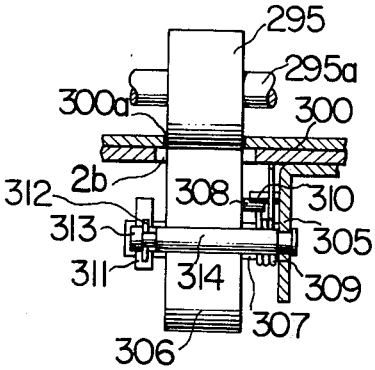
FIG. 27 is an elevational section showing the rear side arrangement of the apparatus shown in FIG. 26, FIGS. 28 and 29 are elevational sections illustrating the manner of operation of the apparatus shown in FIG. 26.
Figure 28:
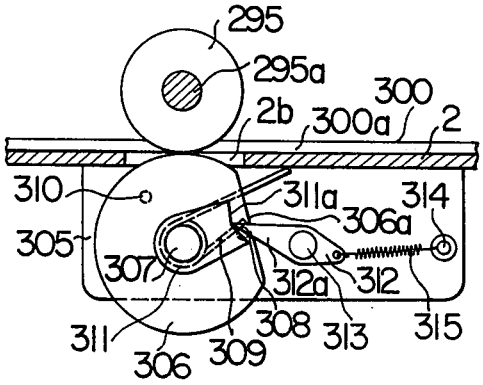
Figure 29:
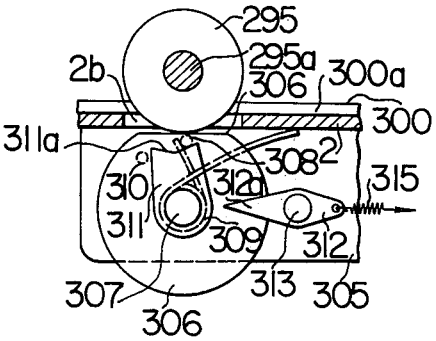

FIGS. 26 to 29 show an alternative embodiment of the invention incorporating a sheet feeding roller 295. Referring to FIGS. 26 and 29, a vertical support plate 305 is fixedly mounted on the lower surface of the sheet receptacle 2, and a detecting roller 306 is rotatably mounted on a shaft 307, which is mounted on the support plate 305, at a position in which the detecting roller 306 cooperates with the roller 295 to provide a detection of the termination of sheet delivery. The detecting roller 306 has a notch 306*a* around part of its periphery for the purpose of detecting a sheet. A torsion spring 309 is wound about the shaft 307 of the detecting roller 306, and has its one end bearing against the lower surface of the sheet receptacle 2 and its other end engaged with a pin 308 fixedly mounted on the end face of the roller 306, the spring urging the roller 306 to rotate clockwise as indicated by an arrow *a*. The roller 306 is held in its initial position shown in FIG. 26 by abutment of the pin 308 against a pin 310 mounted on the support plate 305, and in this position, the notch 306*a* is slightly displaced to the left, as viewed in FIG. 26, from the slot 2*b*.

Fixedly mounted on the shaft 307 of the roller 306 is a first control member 311 having a recess 311*a* at its forward end which is substantially aligned with the notch 306*a*. On the other hand, to the right of the roller 306 as viewed in FIG. 26, a second control member 312 having a pointed detent 312*a* is pivotally mounted at pivot 313 on the support plate 305, the detent having a length to reach within the radius of rotation of the first control member 311. In the initial condition, the second control member is held in a horizontal position by a spring 315 having its one end engaged with the opposite end of the detent and its other end hooked with a pin 314 fixedly mounted on the support plate 305.

Assuming that the sheets have been exhausted and the sheet feeding roller 295 is brought into contact with the detecting roller 306 to effect the idling sheet feeding operation for the first time, the detecting roller 306 is rotated in the opposite direction from that indicated by the arrow *a* against the action of the torsion spring 309. The roller 306 has a peripheral length which is slightly greater than the peripheral length of the roller 295, so that when the roller 295 has completed one revolution, the roller 306 rotates by an amount which corresponds to three fourth of its one revolution. The first control member 311 rotates with the roller 306 to move the second control member 312, the detent 312*a* of which becomes engaged with the recess 311*a* as shown in FIG. 28.

when the sheet feeding roller 295 has completed its delivery operation, the detecting roller 306 tends to return to its original position under the action of the spring 309, but such returning movement is prevented by the engagement between the first and second control members 311, 312, whereby the roller 306 is maintained in the position shown in FIG. 28. When the sheet feeding roller 295 effects another idling sheet delivery operation under this condition, the detecting roller 306 is further rotated against the action of the spring 309 to reach a position shown in FIG. 29 in which the notch 306*a* comes opposite to the roller 295, whereupon the roller 295 falls down by an amount corresponding to the notch 306*a*, producing a large variation in its position. Such variation is transmitted to a detecting switch SW either directly by the roller 295 or its shaft 295*a*, or indirectly through a lever. It will be noted that during the movement of the first control member 311 from the position shown in FIG. 28 to the position shown in FIG. 29, the second control member 312 is disengaged from the first control member 311 to return to its horizontal position under the action of the spring 315, so that it does not prevent the returning movement of the roller 306 together with the first control member 311 to its original position as it is released from the roller 295.

In this manner, the sheet feeding roller can be utilized to the detection of detect sheet delivery in accordance with the invention.

While in the above embodiments, a signal has been produced in response to the second movement of the detecting member, it will be appreciated that the detecting member can be subjected to a plurality of idling operations and a signal can be produced in response to the last movement of the detecting member in accordance with the invention. This can be easily accomplished in the embodiment shown in FIG. 12, for example, by providing (N−1) sets of detent members 270 and associated parts to allow N times movement, or by choosing a large diameter of the roller 306 in relation to the diameter of roller 295 in the embodiment of FIG. 26 and providing (N−1) sets of second control members 312 and associated parts.

Figure 30:
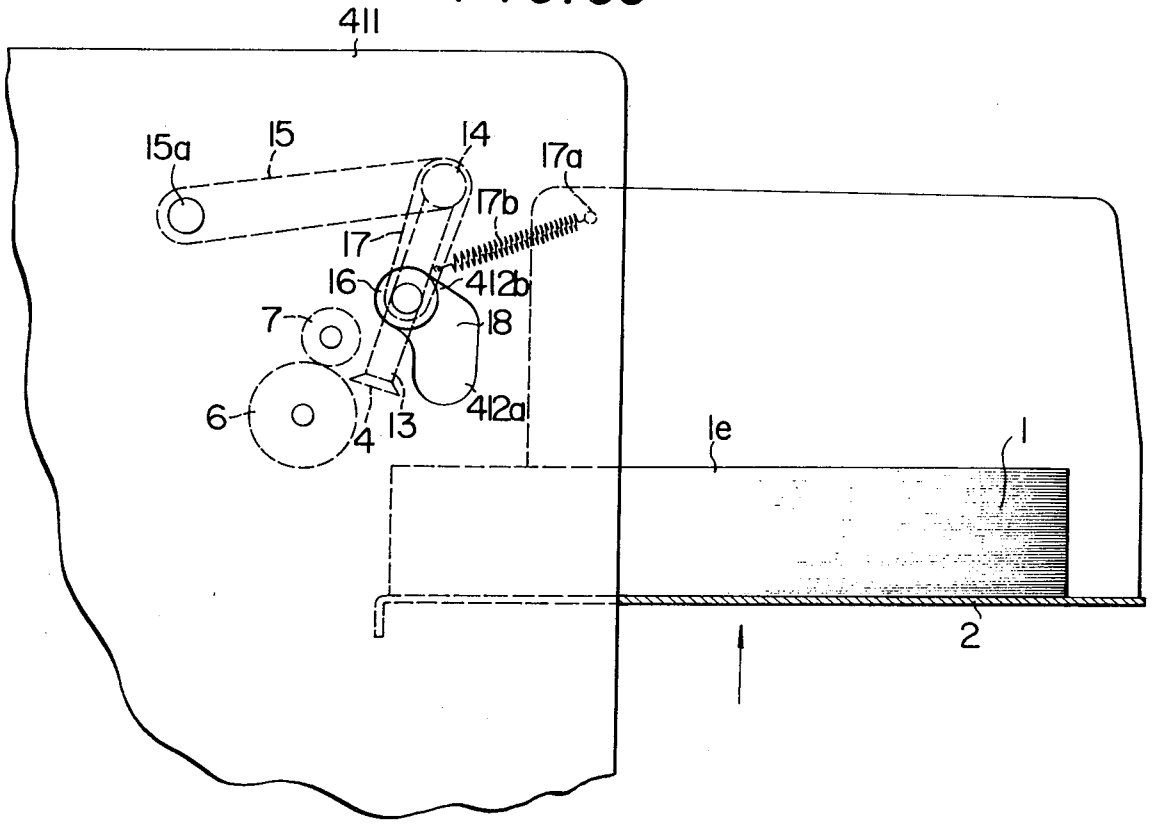
FIG. 30 is a side elevation showing one example of the sheet feed apparatus.
Figure 31:
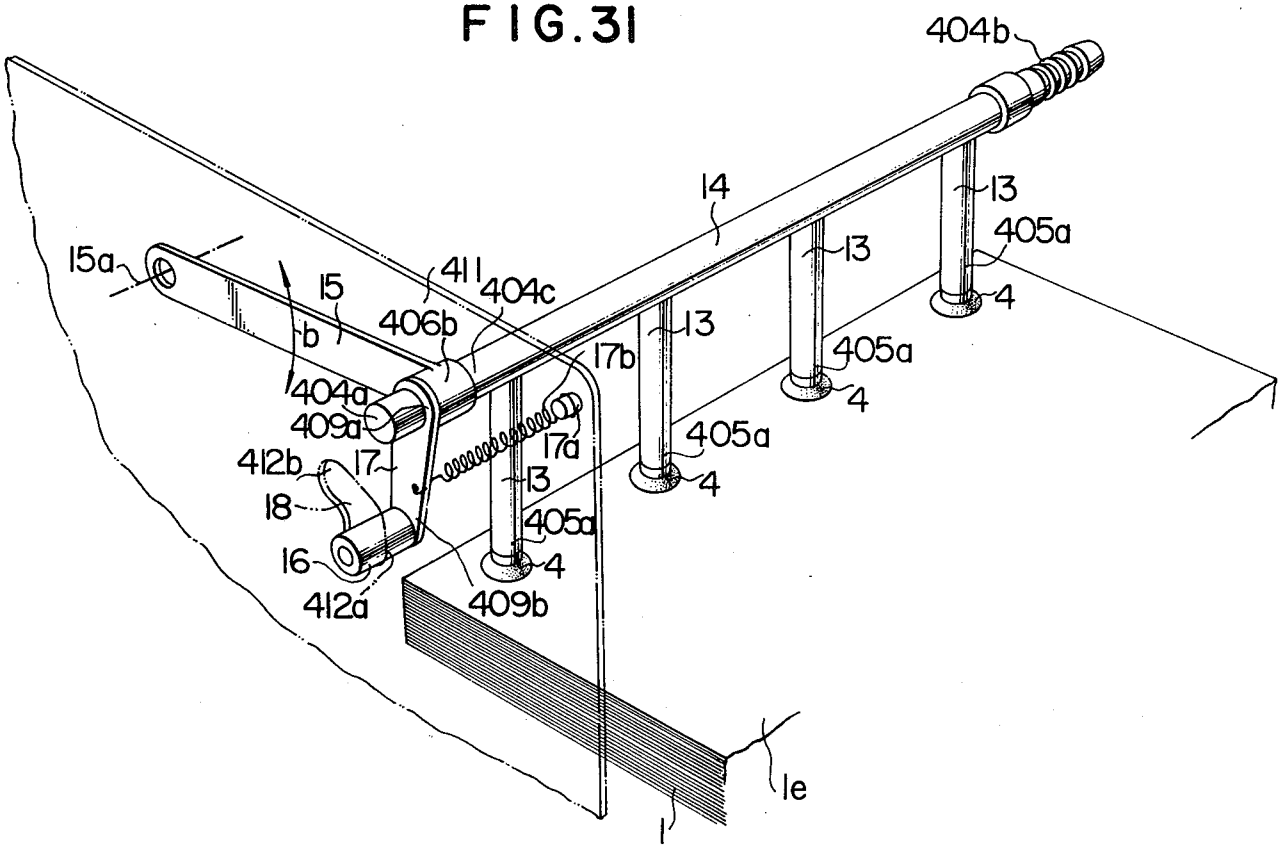
FIG. 31 is a perspective view showing principal parts of FIG. 31.
Figure 34:
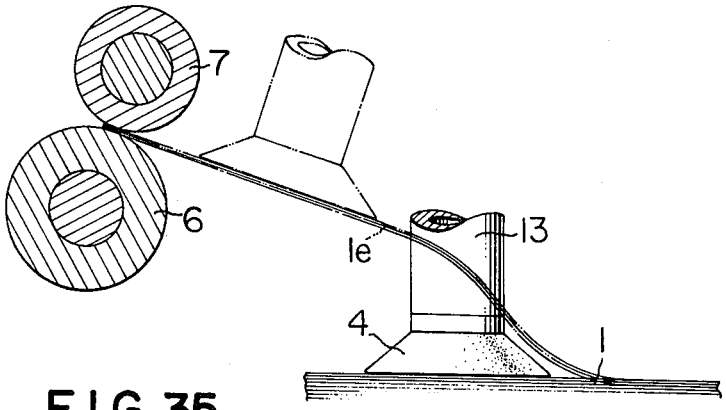
FIGS. 34 and 35 are schematic views for illustrating the drawbacks of a sheet feed apparatus employing a sucker.
Figure 35:
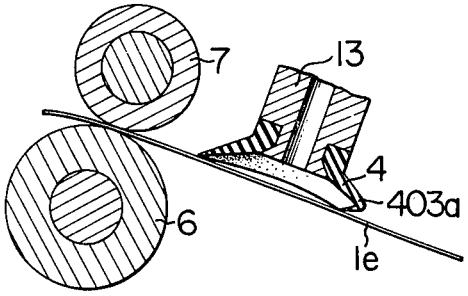

An example of a sheet feed apparatus incorporating a sucker will be described with reference to the drawings. As shown in FIG. 30, sheets 1 are placed as a stack on the sheet receptacle 2. The sheet receptacle 2 is adapted to be raised by an amount corresponding to the thickness of one sheet by a mechanism not shown, as the uppermost sheet 1e of the stack of sheets 1 is delivered onto a sheet feeding path, so as to maintain the uppermost sheet 1e at a fixed position. As shown in FIG. 31, a plurality of suckers 4 are disposed above the forward end of the uppermost sheet 1*e*, and adapted to suck the uppermost sheet 1*e* and raise it from the stack and carry it into the sheet feed path. The suckers 4 are secured to the free ends 405*a* of a plurality of tubular arms 13, respectively, which are integral with a hollow shaft 14. The tubular arms 13 communicate with the hollow shaft 14 and constitute respective suction passages for allowing the sucking operation by the respective suckers 4. The hollow shaft 14 is mounted horizontally in parallel relationship with the forward edge of the sheets 1 of the stack, and is closed at its one end 404*a* while its other end 404*b* is connected with a suction pump, not shown, so as to apply a suction to the hollow shaft 14 and the tubular arms 13 when the suction pump is operated to cause the sucking operation by the suckers 4.

At its end 404*c*, the hollow shaft 14 is rotatably carried by the end 406*b* of an arm 15 which is pivotally mounted on a shaft 15*a*, fixedly mounted on a stationary member, for rocking motion about the shaft 15*a* with a constant period, as shown by a both-ended arrow, when it is driven by the rotation of the group of cams 19 (see FIG. 1). The hollow shaft 14 moves vertically as the arm 15 is subjected to rocking motion. Attached to the end 404*c* of the hollow shaft 14 is an arm 17, the free end 409*b* of which extends downwardly and is attached with a roller 16 externally. The roller 16 fits in a guide slot 18 formed in a side wall 411 shown in phantom lines. As shown in FIG. 30, the guide slot 18 comprises a vertical slot 412*a* and an upper inclined slot 412*b*, and as the arm 15 rocks counterclockwise about its shaft 15*a* to cause the hollow shaft 14 to rise, the roller 16 fitting in the slot 18 moves upwardly within the slot 412*a* of the guide slot 18, by transmission of motion through the arm 17, and subsequently moves toward the upper left, as viewed in FIG. 30, within the slot 412*b*, causing the hollow shaft 14 to rotate clockwise about its axis and to move upwardly while rotating. The arm 17 is engaged by a coiled return spring 17b which extends between the free end 409*b* of the arm 17 and a pin 17*a* firmly mounted on a stationary member. As the arm 15 rocks clockwise about the shaft 15*a* to return to the suction pipe 14 to its lower position, the spring 17*b* is effective to pull the arm 17 to cause the roller 16 to be displaced from the upper slot 412*b* toward the lower slot 412*a* of the guide slot 18, thereby rocking the hollow shaft 14 counterclockwise about its axis through the arm 17 and returning it to its initial position. In this manner, the hollow shaft 14 is subjected to both vertical motion and rotation, and the respective tubular arms 13 secured to the hollow shaft 14 are subjected to a resultant motion comprising vertical and rocking motions. As shown in FIG. 32, the hollow shaft 14 is formed with an aperture 414 which makes the sucking operation by the suckers 4 inoperable. The aperture 414 is formed in the hollow shaft 14 adjacent to the base 405*b* of the tubular arms 13 at which they are fixedly mounted in the hollow shaft 14, and provides a communication between the external atmosphere and the suction passage within the hollow shaft 14. A plurality of such apertures 414 may be associated with respective tubular arms 13, or alternatively a single aperture 414 may be formed in association with one of the tubular arms 13. Where a single aperture 414 is provided, it should desirably have a large diameter. Normally, the aperture or apertures 414 are blocked by a closure member 415 which comprises a pliable material such as rubber or vinyl and which is secured to one arm end 416*a* of a rocking plate 416, as shown in FIGS. 32 and 33. The rocking plate 416 is pivotally mounted by means of a pivot 419 that is mounted on a mounting member 418 which is in turn secured to the outer periphery of a suction pipe 405 by means of a set screw 17. One arm 416*b* of the rocking plate 416 extends to a region adjacent to the aperture 414 and is attached with the closure member 415 at a position which is aligned with the aperture 414. The other arm 416*c* of the rocking plate 416 extends downwardly in parallel relationship with the tubular arm 13 and forms an abutment against a stop 420. The rocking plate 416 is biased clockwise, as viewed in FIG. 32, about its pivot 419 by a compressed coiled spring 421 which is disposed between the other arm 416*c* and the mounting member 418, such clockwise rotation of the rocking plate being prevented by the abutment of the closure member 415 against the hollow shaft 14 to block the aperture 414. As a consequence, the aperture 414 is normally closed to interrupt the communication between the suction passage and the external atmosphere. On the opposite side of the hollow shaft 14 from the aperture 414, the hollow shaft is formed with a threaded hole which is engaged by an adjustable screw 422 which extends toward the aperture 414. The adjustable screw 422 has a diameter greater than that of the aperture 414, and serves adjusting the flow through the aperture 414 into the suction passage from the exterior, by extending toward the aperture 414 to a varying distance. The distance by which the screw 422 extends into the hollow shaft 14 is fixed by a nut 423.

A sheet feed path is formed to the left (as viewed in FIG. 32) of the tubular arms 13 thus constructed, and is defined by a pair of feed rollers 6, 7. When the suckers 4 moves forwardly while moving upward as a result of the movement of the respective tubular arms 13, the uppermost sheet 1e sucked by the suckers 4 has its forward edge fed into the bite between the pair of feed rollers 6, 7. The stop 420 is disposed above the pair of rollers 6, 7 and bears against the other end 416*c* of the rocking plate 416 as the hollow shaft 14 is moved. The stop 420 comprises a stud which is threadably engaged in a mounting member 427 that is secured to a shaft 425 by means of a set screw 426. By adjusting the amount by which the stop 420 is screwed into the mounting member 427, the position at which the arm 416*c* abuts against the stop can be adjusted, and such adjustable position is fixed by a nut 428.

The apparatus thus constructed operates as follows:

When the suction pump is driven, suction is applied to the suction passage formed by the hollow shaft 14 and the tubular arms 13 to initiate the sucking operation by the suckers 4, whereby the forward end of the uppermost sheet 1e is sucked by the suckers 4. Subsequent to the sucking of the sheet, the arm 15 oscillates counterclockwise about its shaft 15*a*, and as the arm oscillates, the hollow shaft 14 moves upwardly, whereby the suckers lift the sucked sheet 1e. At the same time, the roller 16 moves upwardly in the guide groove 18 toward the upper slot 412*b*. As the roller moves through the upper slot 412*b*, such motion is transmitted through the arm 17 to oscillate the hollow shaft 14 clockwise about its axis. As the hollow shaft 14 oscillates, the tubular arms 13 and the suckers 4 also oscillate as shown in phantom lines in FIG. 32 to carry the forward end of the sheet 1e sucked by the suckers toward the feed rollers 6, 7 and into the bite therebetween. At the end of the rocking motion of the tubular arms 13, the arm 416*c* of the rocking plate 416 moves into abutment against the stop 420, whereupon it oscillates counter-clockwise about the pivot 419 against the resilience of the spring 421. Such oscillation results in a movement of the closure member 415 away from the aperture 414, as shown in chain lines in FIG. 32. The opening of the aperture 414 takes place simultaneously with or immediately after the movement of the forward end of the sheet 1*b* into the bite between the feed rollers 6, 7. As the aperture 414 opens, the external air flows into the suction passage through the aperture 414, and thence into the hollow shaft 14, whereby the suckers 4 attached to the free ends of the tubular arms 13 lose the sucking capability to release the front end of the sheet 1e therefrom. However, by this time, the sheet 1e is already held between the feed rollers 6, 7, which carry the sheet toward a given position.

When the arm 15 oscillates clockwise about its shaft 15*a*, the hollow shaft 14 descends, and in the course of such descent of the hollow shaft, the return spring 17*b* and the guide slot 18 are effective to return the suckers 4 removed from the sheet 1e back to its original position. When the hollow shaft returns, the rocking plate 416 is removed from the stop 420 and hence oscillates clockwise about its pivot 419 under the action of the spring 421, thereby blocking the aperture 414. The suckers 4 are now ready to operate on the next or uppermost sheet.

With a sheet feed apparatus incorporating suckers, sheets without pre-treatment on their surfaces can be directly raised from the sheet receptacle and carried to a feed path by the suckers, without marring their surfaces.

However, a sheet feed apparatus incorporating suckers suffers from the following drawbacks: Sheets 1 stacked on the sheet receptable 1 are held in close contact with each other because of the stacking pressure. When the suckers 4 press against and lift the uppermost sheet 1e of the stack of sheets held in close contact, there occurs a likelihood that the second or third sheets are also raised together with the uppermost sheet 1e to be carried into the feed path in lapping relationship with the uppermost sheet 1e. The drawback of such a lap feed is eminently noted when the sheet comprises a thin and relatively tough material.

In addition, when the uppermost sheet 1e is carried by the suckers 4 to a feed path and its forward end is held between the feed rollers 6, 7 which define the feed path, the feeding of the sheet 1e by the feed rollers 6, 7 may result in rubbing the opening area or suction sealing area of the suckers 4 by the sheet 1e. When the forward end of the sheet 1e is held between the feed rollers 6, 7, the suckers 4 are rendered inoperative in its sucking capability, but even if they are rendered inoperative, the sheet 1e having its forward end held between the feed rollers 6, 7 start running at the instant when the suckers are rendered inoperative or immediately thereafter. When the sheet starts running, the rear margin 403a, as viewed in the direction in which the sheet is fed, of the sheet sucking area of the suckers 4 will be turned over in the running direction of the sheet as a result of a rubbing by the sheet 1e. While this turning over is restored by the resilience of the material constituting the sucker 4 as it starts returning and becomes removed from the surface of the running sheet, the rear portion 403a will be abraded when the turning over is repeated each time a sheet is fed, thereby resulting in an adverse degradation of the sucking capability of the suckers 4.

Examples of an apparatus which overcomes such problems will be described below. In one example, the apparatus includes a retainer member which is operative, when the uppermost sheet is sucked by the suckers, to prevent an area immediately around the portion of the uppermost sheet 1e to which the suction is directly applied from rising up and deform the uppermost sheet as said portion is sucked, thus preventing the next uppermost sheet which is in closed contact with the uppermost sheet from being lifted by suction created therebetween. In another example, the apparatus includes a thrusting member which is operative, when the uppermost sheet 1e is sucked by the suckers, to thrust the rear margin of the portion of the sheet to which the suction is applied away from the suckers to create, by deformation of the sheet fed, a clearance between the rear margin of the suckers and the sheet fed, thereby eliminating the turning over of the rear margin of the suckers upon initiation of the running of the sheet.

Figure 36:
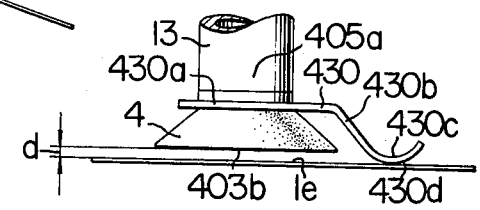
FIG. 36 is a side elevation of a device for preventing a lap feed of sheets according to one embodiment of the invention.

Referring to FIG. 36, a retainer member 430 is secured at its base 430a to the forward end 405a of the tubular arm 13 at which the base of the sucker 4 is mounted. The retainer member 430 is formed of a rigid sheet material and has its free end 430b extending downwardly and rearwardly of the sucker 4 with a curve 430c formed in its end. The bottom 430d of the curve 430c is positioned below the level of the bottom opening 403b of the sucker 4, thereby forming a vertical slit distance *d* not greater than 1 mm between the horizontal plane including the opening 403b and the horizontal plane including the bottom 430d.

Figure 37:
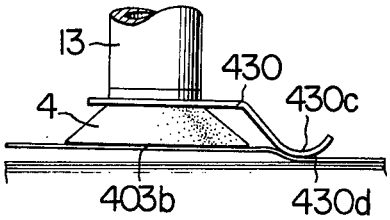
FIG. 37 is a schematic view showing the device shown in FIG. 36 in its operative position.

With the provision of such retainer member 430, the area immediately adjacent to the portion of the uppermost sheet 1e to which the suction is directly applied by the sucker 4 bears against the bottom 430d of the retainer member 430 when the sucker 4 is positioned above the uppermost sheet 1e to feed it, as shown in FIG. 36. In this manner, a slit having a distance *d* is formed between the top surface of the uppermost sheet 1e and the opening of the sucker 4. When the suction is applied to the sucker 4, only that portion of the uppermost sheet 1e which is directly opposite to the sucker 4 will be sucked while its area adjacent to such portion is retained by the retainer member 430, thereby causing a deformation of the sheet 1e as shown in FIG. 37. Because of the toughness of the sheet, the second sheet which is in close contact with the uppermost sheet 1e cannot deform to follow the the latter, upon occurrence of the deformation in the uppermost sheet, whereby only the above mentioned portion of the uppermost sheet 1e will be sucked by the sucker 4. In this manner, it is assured that only the uppermost sheet 1e is carried to the feed path by the movement of the sucker 4, thus preventing a lap feed. While in the above embodiment, the retainer member 430 which prevents the lap feed is formed to have its free end 430b and the curve 430c formed therein extending rearwardly of the sucker 4, the free end 430b may extend in any desired direction provided it is located adjacent to the portion of the sheet to which the suction is directly applied. Also, while in the embodiment described above, the base 430a of the sheet retainer member 430 is secured to the tubular arm 13, the retainer member may be mounted on a stationary member, the only requirement being that the operative part or the curve of the retaining member is positioned to prevent the area around that portion of the sheet to be fed which is directly opposite to the sucker from being lifted up.

Figure 39:
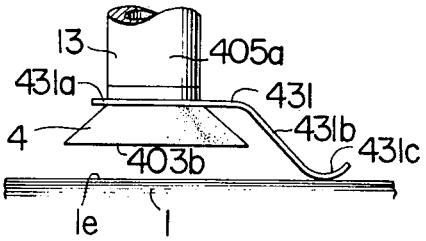
FIG. 39 is a side elevation of a sucker provided with a thrusting member which prevents turn-over of the sucker.
Figure 40:
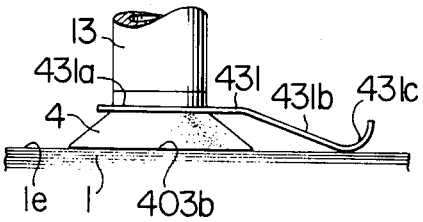
FIGS. 40 and 41 are schematic views illustrating the operation of the device shown in FIG. 39.
Figure 41:
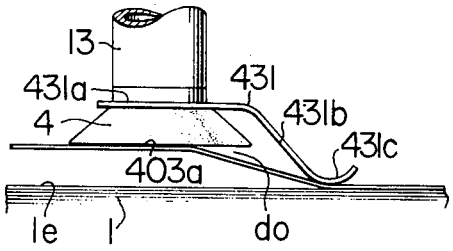

FIG. 39 shows the principle of construction for a thrusting member 431 which prevents the turning over of the rear margin 403a of the sucker 4. As shown, the thrusting member 431 is secured at its base 431a to the forward end 405a of the tubular arm 13. The thrusting member 431 is formed of a resilient sheet material and has its free end 431b extending rearwardly of the sucker 4 with a curve 431c formed in the downwardly bent end thereof. The curve 431c is positioned below the level of the bottom opening 403b of the sucker 403. When the sucker 4 is positioned above the uppermost sheet 1e in order to feed this sheet, the curve 431c bears against the top surface of the sheet 1e, as shown in FIG. 39, and when the sucker 4 is lowered to suck the directly opposite portion of the sheet 1e, the thrusting member 431 has its free end 431b deformed, by bending, to be shifted upwardly against its own resilience, as shown in FIG. 40. Thus at this time, both the bottom opening 403b of the sucker 4 and the bottom of the curve 431c abut against the top surface of the sheet 1e. It will be understood that the portion of the sheet which bears against the sucker 4 is attracted upwardly by suction while the adjacent area of the sheet 1e which bears against the curve 431c is urged downwardly. When the sucker 4 subsequently moves upwardly from this position, the sheet portion that is directly sucked by the sucker 4 will be raised by the sucker 4, while the adjacent area of the sheet which bears against the curve 431*c* remains under pressure by virtue of the resilience of the thrusting member 431, so that as shown in FIG. 41, as the sucker 4 moves further upwardly, the sheet portion to which the suction is directly applied from the sucker will be gradually separated from the sucker, starting from the rear margin thereof. As the sucker 4 continues its upward motion to raise the thrusting member 431 to its initial position, a clearance $d_0$ will be formed between the rear margin 403*a* of the sucker 4 and the directly opposite portion of the sheet. The sheet 1e is carried to its feed path while maintaining such relative position. When such condition is achieved, the clearance $d_0$ formed between the rear margin 403*a* of the sucker 4 and the directly opposite sheet portion prevents the rear margin 403*a* from being rubbed by the running sheet 1e as the front end of the sheet 1e is engaged between feed rollers 6, 7 (see FIG. 32) to start its running by the feeding operation of these feed rollers, thus avoiding the turning over of the sucker.

Figure 38:
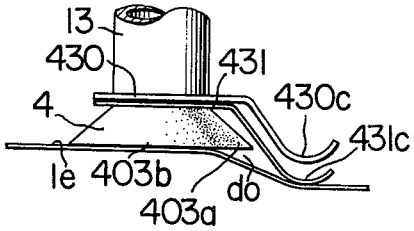
FIG. 38 is a side elevation of a device having a sheet retainer member and a sheet thrusting member.

As shown in FIG. 38, the thrusting member 431 and the retainer member 430 may be used in combination to avoid both the lap feed of the sheets and the turning over of the margin of the sucker 4. When both of the members 430 and 431 are used in combination, they should be located at different angular positions around the periphery of the sucker 4 lest their curves 430*c*, 431*c* should lie one above another.

Figure 42:
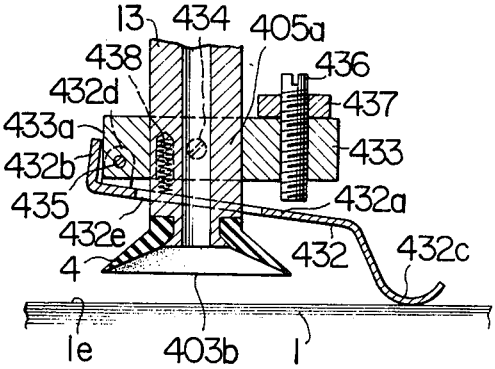
FIG. 42 is a section of another example of the device for preventing a lap feed of sheets.
Figure 43:
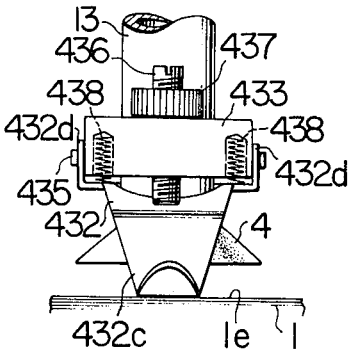
FIG. 43 is a right-hand side elevation of the device shown in FIG. 42, FIGS. 44 and 45 are views illustrating the operation of the device of FIG. 42.

In the embodiment to follow, both the retainer member 430 and the thrusting member 431 are implemented into a single urging plate 432 which is formed of a rigid body. The urging plate 432 is adapted both to suppress the area adjacent to the directly sucked portion of the sheet from being lifted up and to thrust the sucked sheet away from the rear margin of the sucker. This embodiment will be described with reference to the drawings. As shown in FIGS. 42 and 43, a mounting member 433 for the urging plate 432 is fixedly secured, by means of set screws 434, to the forward end 405a of the tubular arm 13 at which the sucker 4 is fixedly mounted. The urging plate 432 is rockably disposed below the mounting member 433 by pivotally mounting tabs 432*d*, 432*d*, bent upwardly from its opposite lateral sides, on a pivot 435 which extends through the mounting member 433 so as to be rockable. The rear extension 432*a* of the urging plate 432 which extends below the mounting member 433 is formed with an aperture 432*e* through which the tubular arm 13 extends, the forward end 405*a* of the suction pipe extending through this aperture 432*e*. The free end of this rear extension 432*a* is folded downward and is formed in its extremity with a curve 432*c* which serves suppressing the area around the directly sucked portion of the sheet from lifting up and thrusting the sheet away from the rear margin of the sucker. At a position opposite to the extension 432*a* including the aperture 432*e* and the curve 432*c*, the mounting member 433 is provided with a stop 436 which limits the displacement of the extension 432*a* when it tends to move upwardly. In the present embodiment, the stop 436 comprises a threaded shaft which is screwed into the mounting member 433 from above and extends therethrough, the lower end surface of the threaded shaft being adapted to abut against the extension 432*a* to prevent its counterclockwise rocking motion of the urging member 432 (as viewed in FIG. 42). The amount by which the stop 436 is screwed into the mounting member can be preset by a nut 437 which threadably engages with the stop. The urging member 432 is biased to rotate clockwise about the pivot 435 by a pair of compressed springs 438, 438 disposed between the mounting member 433 and the rear extension 432*a* of the urging member 432. However, the rotation of the urging member 432 is prevented by the abutment against a front wall 433*a* of the mounting member 433 of a folded portion 432*b* which is formed in the urging member so as to extend upwardly from the plane of its extension. In the position in which the folded portion 432*b* abuts against the front wall of the mounting member 433 to prevent the rotation of the urging member 432, the curve 432*c* formed in the rear extension of the urging member assumes a position which is below the opening 403*b* of the sucker 4, as shown in FIG. 42. The position of the stop 436 is adjusted such that the bottom surface of the curve 432*c* is slightly below the opening 403*b* of the sucker 4 when the urging member 432 is oscillated counterclockwise about the pivot 435 against the resilience of the springs 438 so that the rear extension 432*a* abuts against the stop 436 to prevent such oscillating motion.

Figure 44:
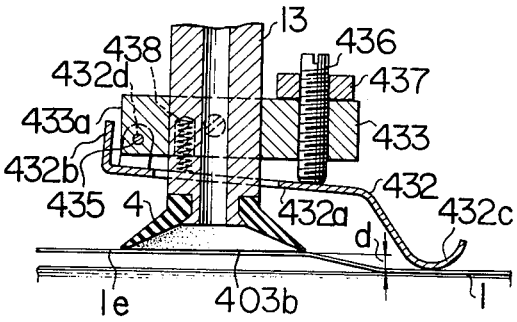
Figure 45:
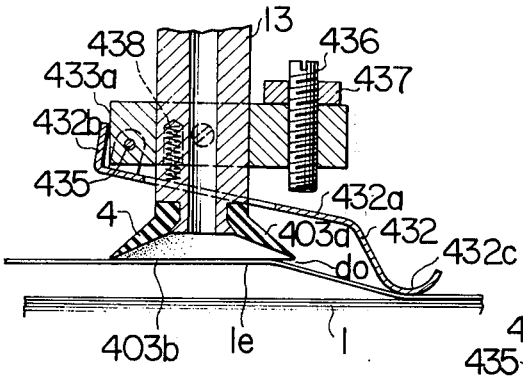

The apparatus described above operates as follows:

When the suckers 4 are located above the uppermost sheet 1e to be fed and is lowered toward the sheet 1e, the curve 432*c* initially abuts against the sheet 1*e*. When the suckers continue to descend, the urging plate 432 is oscillated counterclockwise about the pivot 435 against the resilience of the springs 438, 438 to assume a position as shown in FIG. 44, in which the rear extension 432*a* abuts against the lower end surface of the stop 436 to prevent its oscillating motion. The position in which the oscillating motion of the urging plate 432 is interrupted corresponds to a position in which the slit distance *d* mentioned above is formed between the opening 403*b* of the sucker 4 and the bottom of the curve 432*c*. In this position, the suckers 4 operate to apply suction to the sheet 1*e*. As a sheet is sucked, the urging plate 432 serves as a retainer member, whereby the area adjacent to the directly sucked portion of the sheet is retained in position by the curve 432*c* and is prevented from lifting up, thus allowing only the portion of the sheet which is directly opposite to the sucker 4 to be sucked thereby. As a result, the sheet 1*e* is deformed as shown in FIG. 44, and the next uppermost sheet which is in close contact with the sheet 1e can not be deformed to follow the deformation of the sheet 1e, thereby preventing a lap feed of sheets fed. Subsequently when the suckers 4 raise the sucked sheet 1e, the urging member 432 now serves as a thrusting member. Specifically, when the suckers 4 raise the sucked sheet 1e, the resilience of the springs 438 acts on the urging member 432 to cause it to oscillate clockwise about the pivot 435 as the suckers 4 move upwardly. Since the urging member continues to thrust the area of the sucker sheet 1e which is around the sheet portion directly opposite to the suckers, there is formed a gradually increasing clearance between the rear margin 403*a* of the sucker 4 and the sucked sheet as the suckers 4 move upwardly. When the suckers 4 have moved to a vertical position in which the folded portion 432*b* abuts against the front wall 433*a* of the mounting member 433 to prevent the oscillating motion of the urging member, a clearance $d_0$, as shown in FIG. 45, is formed between the rear margin 403*a* of the sucker 4 and the sucked sheet. The suckers 4 carry the sheet 1*e* to the feed path while maintaining such relative position, so that the forward end of the sheet 1e can be engaged between the feed rollers 6, 7 (see FIG. 32) to be subjected to the feeding operation without causing the turning over in the rear margin 403a of the suckers.

Figure 46:
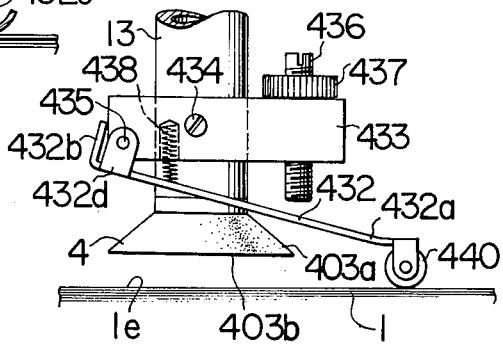
FIG. 46 is a side elevation of a further example of the device for preventing a lap feed of sheets.

In the above embodiment, the provision of the curve 432, which retains and thrusts the sheet away, in the free end of the rear extension 432a of the urging member 432 may result in a rubbing of the top surface of the sheet 1e by the curve 432c when the sheet 1e is sucked by the suckers 4 and when the sucked sheet is separated therefrom. FIG. 46 shows another embodiment in which the curve 432c is replaced by a roller 440. The rolling of the roller 440 prevents the rubbing of the sheet surface, and thus prevents a lap feed of the turning over without marrying the surface.

From the foregoing, it will be appreciated that the invention completely prevents a lap feed of sheets fed and the turning over of suckers by utilizing a sophisticated deformation in the sucked sheet when a sheet to be fed is sucked by the suckers and the sucked sheet is subjected to a feeding operation.

What is claimed is:

1. In apparatus for feeding successive sheets, in combination, a. a sheet receptacle for supporting a stack of sheets to be fed;

b. means, including a cyclically operable sheet-feeding element engageable with the uppermost sheet of a stack on the receptacle, for successively feeding sheets therefrom;

c. a detecting member for detecting the termination of sheet delivery, said detecting member being movable, by an idling sheet-feeding operation of the feeding element when the sheets on the sheet receptacle have been exhausted, through a range of positions including a predetermined position;

d. means for producing a signal indicative of the detection of the termination of sheet delivery in response to movement of said detecting member to said predetermined position; and e. means for controlling movement of said detecting member in response to idling operation of the feeding element such that said detecting member reaches said predetermined position upon completion of a predetermined plural number of idling sheet-feeding operations of said feeding element.

2. Apparatus as defined in claim 1, wherein said feeding element is a sheet-feed roller engageable with the topmost sheet of a stack on said receptacle.

3. Apparatus as defined in claim 2 wherein said detecting member comprises a planar element supported on said receptacle for engagement and movement in one direction by said roller during each idling operation of said roller, a connecting element pivotally secured to and movable with said planar element, and biasing means resiliently opposing movement of said planar element in said one direction for restoring said planar element to an initial position after each idling operation of said roller, said connecting element being pivotally movable away from and into said predetermined position during a cycle of movement of said planar element; wherein said signal-producing means comprises a switch, and means carried by said connecting element for engaging and actuating said switch upon movement of said connecting element into said predetermined position; and wherein said movement-controlling means comprises a control member pivotally movable between a first position for guiding said connecting element away from said predetermined position, and a second position for guiding said connecting element into said predetermined position, said control member being shifted between said first and second positions by successive cycles of movement of said planar element.

4. Apparatus as defined in claim 1 wherein said detecting member comprises a detecting roller disposed beneath said sheet-feed roller so as to be engaged and rotated thereby during each idling operation of said sheet-feed roller, said detecting roller having a radius larger than the radius of said sheet-feed roller and having a longitudinal notch, said sheet-feed roller being supported for vertical movement so as to drop downwardly into a bottom position when said notch is oriented in facing relation thereto; wherein said signal-producing means comprises means for producing a signal in response to movement of said sheet-feed roller into said bottom position; and wherein said movement-controlling means comprises means for releasably holding said detecting roller at an intermediate angular position, said detecting roller having a radius, and an initial angular position, such that a first idling operation of said sheet-feed roller rotates said detecting roller from said initial position to said intermediate position while said notch is continuously facing away from said sheet-feed roller, and a second idling operation of said sheet-feed roller further rotates said detecting roller from said intermediate position to said predetermined position in which said notch is disposed in facing relation to said sheet-feed roller.

5. Apparatus as defined in claim 1, wherein said sheet-feeding element comprises at least one sucker movable into and out of engagement with a stack of sheets on said receptacle for grasping a sheet by suction and lifting it.

6. Apparatus as defined in claim 5 wherein said detecting member comprises a movably supported sheet-like member disposed to be engaged and slightly lifted by said one sucker during each idling operation thereof, and thereafter to drop back to an initial level as the same idling operation is completed, and means resiliently biasing said sheetlike member for movement in one direction toward said predetermined position, said one direction being transverse to the direction in which said sheetlike member is lifted; wherein said signal-producing means comprises a switch disposed to be actuated by arrival of said sheetlike member at said predetermined position; and wherein said movement-controlling means comprises detent means for releasably arresting said sheetlike member at an initial position and an intermediate position spaced from said initial position in said one direction, said detent means releasing said sheetlike member from said initial position and from said intermediate position upon successive lifting movements of said sheetlike member such that said sheetlike member reaches said predetermined position only after two successive idling operations of said sucker.

7. Apparatus as defined in claim 5 wherein said detecting member comprises a bellows opening upwardly in register with said sucker such that said bellows is contracted by suction of said sucker during each idling operation of said sucker, and a rod connected to said bellows such that one end of the rod is lifted from an initial position during each contracting movement of said bellows, said one rod end being also movable, transversely of the direction of lifting, away from and into said predetermined position as said one rod end is lifted as aforesaid; wherein said signal-producing means comprises a switch disposed to be actuated by arrival of said one rod end at said predetermined position; and wherein said movement-controlling means comprises a control member pivotally movable between a first position for guiding said one rod end away from said predetermined position and a second position for guiding said one rod end into said predetermined position, said control member being shifted between said first and second positions by successive lifting movements of said one rod end.

* * * * *